US011001088B2

(12) United States Patent
Dhinojwala et al.

(10) Patent No.: US 11,001,088 B2
(45) Date of Patent: May 11, 2021

(54) PRODUCTION OF A WIDE GAMUT OF STRUCTURAL COLORS USING BINARY MIXTURES OF PARTICLES WITH A POTENTIAL APPLICATION IN INK JET PRINTING

(71) Applicants: Ali Dhinojwala, Akron, OH (US); Mario Alberto Echeverri, Northfield, OH (US); Anvay Arun Patil, North Canton, OH (US)

(72) Inventors: Ali Dhinojwala, Akron, OH (US); Mario Alberto Echeverri, Northfield, OH (US); Anvay Arun Patil, North Canton, OH (US)

(73) Assignee: THE UNIVERSITY OF AKRON, Akron, OH (US)

( * ) Notice: Subject to any disclaimer, the term of this patent is extended or adjusted under 35 U.S.C. 154(b) by 0 days.

(21) Appl. No.: 16/701,896

(22) Filed: Dec. 3, 2019

(65) Prior Publication Data

US 2020/0171869 A1 Jun. 4, 2020

Related U.S. Application Data

(60) Provisional application No. 62/774,381, filed on Dec. 3, 2018.

(51) Int. Cl.

| | |
|---|---|
| ***B41M 5/00*** | (2006.01) |
| ***B05D 1/00*** | (2006.01) |
| ***B41J 2/21*** | (2006.01) |

(52) U.S. Cl.

CPC ..... *B41M 5/0017* (2013.01); *B05D 1/62* (2013.01); *B41J 2/2103* (2013.01)

(58) Field of Classification Search

CPC ..... B41M 5/0017

See application file for complete search history.

(56) References Cited

U.S. PATENT DOCUMENTS

2015/0273885 A1* 10/2015 Imai ..... B41M 5/0017 347/21

FOREIGN PATENT DOCUMENTS

| | | | |
|---|---|---|---|
| CN | 101758014 A | | 6/2010 |
| KR | 20160000562 A | * | 1/2016 |

(Continued)

OTHER PUBLICATIONS

Liu, G. et al., "Fabrication of Patterned Photonic Crystals with Brilliant Structural Colors on Fabric Substrates Using Ink-Jet Printing Technology." Mater. Des. 2017, 114, 10-17. https://doi.org/10.1016/j.matdes.2016.09.102.

(Continued)

*Primary Examiner* — Julian D Huffman

(74) *Attorney, Agent, or Firm* — Renner, Kenner, Greive, Bobak, Taylor & Weber

(57) ABSTRACT

In one or more embodiments, the present invention provides a method of applying or printing structural colors to a substrate that involves pre-treatment of the substrate surface to prevent absorption of the fluid containing the particles. This allows the fluid to maintain their sessile drop shapes and as the water evaporates, the colloidal particles spontaneously assemble within the confined geometry into semi-ordered structures that interact with light to produce structural color. While the pre-treatment may be done in a variety of ways, application of a, hydrophobic and/or oleophobic coating, like 1H-IH,2H-perfluoro-1-dodecene ($C_{10}F_{21}$—CH═$CH_2$) (perfluoro) monomer, fluoroalkyls, fluorohydroalkyls, cyclo-fluoroalkyls, fluorobenzen, by plasma-enhanced chemical vapor deposition (cold plasma treatment) has been found to be effective, particularly for printing (Continued)

applications. These treated substrates allow production of a wide range of structural colors using binary systems of nanoparticles.

24 Claims, 22 Drawing Sheets
(13 of 22 Drawing Sheet(s) Filed in Color)

(56) References Cited

FOREIGN PATENT DOCUMENTS

| | | | | |
|---|---|---|---|---|
| WO | 2018/117965 | A1 | 6/2018 | |
| WO | WO-2019000702 | A1 * | 1/2019 | ..... B41M 5/0047 |

OTHER PUBLICATIONS

Cui, Liying et al., "Fabrication of large-area patterned photonic crystals by ink-jet printing" J. Mater. Chem., 2009, 19, 5499-5502 DOI: 10.1039/b907472d.
Wang, Jingxia et al., "Patterned photonic crystals fabricated by inkjet printing" J. Mater. Chem. C, 2013, 1, 6048-6058.
Bai, Ling et al., "Bio-Inspired Vapor-Responsive Colloidal Photonic Crystal Patterns by Inkjet Printing" ACSNANO vol. 8, No. 11, pp. 11094-11100.
Bai, L. et al., "Large-Scale Noniridescent Structural Color Printing Enabled by Infiltration-Driven Nonequilibrium Colloidal Assembly." Adv. Mater. 2018, 30 (9), 1-7. https://doi.org/10.1002/adma.201705667.
Nam, H. et al., "Inkjet Printing Based Mono-Layered Photonic Crystal Patterning for Anti-Counterfeiting Structural Colors." Sci. Rep. 2016, 6 (Jan.), 1-9. https://doi.org/10.1038/srep30885.

* cited by examiner

Plastic (PVC)

Metal (stainless steel)

Rubber (Nitrile)

Fabric (100% cotton)

PRODUCTION OF A WIDE GAMUT OF STRUCTURAL COLORS USING BINARY MIXTURES OF PARTICLES WITH A POTENTIAL APPLICATION IN INK JET PRINTING

CROSS REFERENCE TO RELATED APPLICATIONS

This application claims the benefit of U.S. provisional patent application Ser. No. 62/774,381 entitled "Production of a Wide Gamut of Structural Colors Using Binary Mixtures of Particles with a Potential Application in Ink Jet Printing," filed Dec. 3, 2018, and incorporated herein by reference in its entirety.

STATEMENT REGARDING FEDERALLY SPONSORED RESEARCH OR DEVELOPMENT SUPPORT

This invention was made with government support under grant FA9550-18-1-0142 awarded by the Air Force Office of Scientific Research. The government has certain rights in the invention.

FIELD OF THE INVENTION

One or more embodiments of the present invention relates to a use of structural colors. In certain embodiments, the present invention is directed to methods for applying structural colors to a substrate.

BACKGROUND OF THE INVENTION

How color is produced in nature is a critical question from both a fundamental and applied perspective. Birds with brightly patterned wings, colorful flowers, beetles with iridescent cuticles, algae with bioluminescence and countless other examples illustrate the importance of color in nature. Colors can be produced by either pigments or dyes, highly ordered nanostructures or the combination of the two, with the former being extensively employed by man since pre-historic times.

Colorants, like dyes and pigments, are attributed by their ability to either absorb or emit light in the visible range (400-700 nm). In such systems, color is generated by the virtue of exchange of energies between light and electron when the illuminating or incident light excites the electrons within the material to higher energy states. This is a chemical phenomenon. In other systems, colors are produced by manipulation of electromagnetic waves using nanostructures that affect propagation of light, which is a purely physical phenomenon. In these systems colors, referred to as structural colors, are produced by the interaction of light with the various types of spatial inhomogeneities and hierarchical structures (micro- or nanostructures) yielding interference (thin-film or multilayer), scattering or diffraction of light.

Structural colors have raised a significant amount of interest among researchers owing to their unique properties like vibrant appearance (vivid and metallic colors), photostability (non-fading behavior) and energy efficiency (no loss of energy during the physical interaction of light with nanostructures). Standard pigmentary colors are susceptible to photo-bleaching activities due to the presence of unsaturation in their chemical structures, which is eliminated in structural color systems. The last two decades have seen the employment of numerous techniques for generating colloidal nanostructures to produce structural colors such as evaporation-based self-assembly (including vertical and drop deposition), spray coating, reverse emulsion-based assembly, and electrophoretic deposition, that allow the assembly of particles into semi-ordered structures. Recently, drop deposition using a colloidal suspension of nanoparticles (followed by evaporation-based self-assembly of the colloidal nanoparticles into nanostructures), has been in great demand due to the low fabrication costs, great applicability in inkjet printing for scale-up operations and its ability to produce quasi-amorphous assemblies that result in angle-independent color viewing. Moreover, it is possible to employ structural colors in various applications such as decorations, smart windows, humidity-responsive systems, photonic inks or pigments, chemical sensing, nontoxic colors for cosmetics and anti-counterfeiting applications.

Iridescence (angle-dependent behavior) and non-iridescence (angle-independent behavior) are the most common terminologies used in the field of structural colors. Long-range, periodic arrangement of colloidal crystals is known to exhibit iridescent colors, where the colors change depending on the viewing angles. From an industrial standpoint, it is critical to have non-iridescent structural color systems for applications requiring broad-viewing angles like printing. Hence, the concept of having non-fading inks is of great demand in printing industries. Obtaining a short-range order in the packing of colloidal particles is the key to obtain non-iridescent behavior. Such amorphous colloidal arrays can be formed by assembling different-sized particle suspensions, using external stimuli to pace the assembly (like electric field) or creating defects in the colloidal crystallization process.

Semi-ordered colloidal arrays tend to display whitish or washed-off colors due to the strong incoherent scattering of light, which reduces the saturation and quality of the colors significantly. Black materials like carbon black and polydopamine (PDA) (a synthetic mimic of melanin) have been employed in order to address this problem. Their broad-band absorption behavior makes them a direct choice for improving the saturation of structural colors. Although, carbon black is inexpensive and easy to procure in comparison to PDA, the latter have some additional properties like UV protection, multifunctionality as a binder coating, and biocompatibility. Recently, studies have been undertaken to maximize the production of melanins, providing a sustainable alternative to carbon black.

The use of colloidal suspensions for inkjet printing applications has been growing at an accelerated rate due to its novel coloring strategy, avoiding pigment- or dye-based products. Structural color printing facilitates creation of colorful patterns on different substrates without the need for chemical colorants and opens an avenue for applications like anti-counterfeiting and UV-protective paints. However, there are certain challenges while printing these structural color systems. These include—a) requirement of highly concentrated particle suspensions for the printing process to avoid the coffee-ring effect, b) preparation of intricately patterned substrates that favor the assembly of colloidal particles to exhibit color, c) stabilization of such assemblies to prevent them from breaking apart due to external forces, and d) necessity to expand the color gamut expressed by these systems to compete with conventional printing inks. Now in case of colloidal assemblies, the size of the colloidal particle is one of the key factors that determines the hue produced. Nevertheless, one limitation that must be kept in mind is that the synthesis of these different-sized particles to generate color diversity is very tedious.

The multiple components that constitutes a conventional ink imparts several properties such as, preventing clogging of the printing head nozzles, controlling surface tension of the ink, allowing its attachment to the surface of the substrate, slowing the evaporation of the solvent; all of this in order to maintain the pigment on the paper and not spread too much on it. Historically, combinations of red, green and blue colors have been used to produce a wide gamut of colors. During the printing process, the separation between the printed dots determines whether the final image will be dark (closer dots) or bright (farther dots). The primary components of inks are the pigments which vary in sizes from a few nanometers (50 nm) to a couple of microns. Moreover, when a simple suspension of ink particles (comprising only solvent and solid particles) is added to a paper, it would be absorbed by the paper preventing any manifestation of color. To overcome this issue, people have resorted to using high ink particle concentrations (~10-30% w/v) to ensure that an adequate number of particles remain on the surface of the paper to exhibit color.

What is needed in the art is a method for applying or printing structural colors that allows for the production of a wide gamut of non-iridescent colors, does not require high ink particle concentrations (~10%-30% w/v) to ensure that an adequate number of particles remain on the surface of the paper to exhibit color, further reduces or prevents the coffee ring effect (where the color is darker at the edge of the droplet), allows for better printing on white backgrounds, and also allows for the application or printing of structural colors with wavelengths outside the visible range for use in applications like security or anti-counterfeiting operations.

SUMMARY OF THE INVENTION

As set forth above, color production in a structural color system is a result of the physical interaction of the colloidal array with light, making possible to have long-lasting colors, unlike organic dyes and pigments. In one or more embodiments, the present invention provides a method of applying or printing structural colors to a substrate that involves pre-treatment of the substrate surface to prevent absorption of the fluid containing the particles. This allows the fluid to maintain their sessile drop shapes and as the water evaporates, the colloidal particles spontaneously assemble within the confined geometry into semi-ordered structures that interact with light to produce structural color. While the pre-treatment may be done in a variety of ways, application of a oleophobic, hydrophobic and/or superhydrophobic coating, like 1H,IH,2H-perfluoro-1-dodecene ($C_{10}F_{21}$—CH═$CH_2$) (perfluoro) monomer, fluoroalkyls, fluorohydroalkyls, cyclo-fluoroalkyls, or fluorobenzene, by plasma-enhanced chemical vapor deposition (cold plasma treatment) has been found to be effective, particularly for printing applications. In various embodiments, this cold plasma treatment of the substrate surface has been found to be both simple and efficient, making it ideal for printing. Moreover, the pre-treatment reduces or prevents the coffee-ring effect without having to resort to highly concentrated particle suspensions, further reducing costs. In various embodiments, these methods also allow for the production of a wide gamut of non-iridescent colors by using binary mixtures of particles.

In a first aspect, the present invention is directed to a method for applying structural colors to a substrate comprising: treating some or all of a surface of a substrate with a hydrophobic and/or oleophobic coating; preparing a structural color forming suspension comprising a carrier solvent and a plurality of nanoparticles known to form a structural color upon evaporation of the carrier solvent; placing said structural color forming suspension on the treated surface of said substrate, wherein said hydrophobic and/or oleophobic coating on the surface of said substrate substantially prevents adsorption of a structural color forming suspension into said substrate and substantially prevents the structural color forming suspension from moving on said surface; and allowing the carrier solvent to evaporate, whereby the nanoparticles organize to produce a structural color on said substrate. In various embodiments, the substrate is selected from the group consisting of paper, cardboard, plastic, metal, textiles, rubbers and elastomers, wood, glass, and combinations thereof.

In some embodiments, the method for applying structural colors to a substrate of the present invention includes any one or more of the above referenced embodiments of the first aspect of the present invention wherein the step of treating a substrate comprises applying a material selected from the group of 1H,1H,2H-perfluoro-1-dodecene ($C_{10}F_{21}$—CH═$CH_2$), fluoroalkyls, fluorohydroalkyls, cyclo-fluoroalkyls, fluorobenzenes, and combinations thereof, to the substrate by plasma-enhanced vapor deposition. In various embodiments, the method for applying structural colors to a substrate of the present invention includes any one or more of the above referenced embodiments of the first aspect of the present invention wherein the step of treating the substrate is performed by plasma-enhanced vapor deposition, layer-by-layer polymer coating, spin coating, or solvent casting. In one or more embodiments, the method for applying structural colors to a substrate of the present invention includes any one or more of the above referenced embodiments of the first aspect of the present invention wherein the step of treating the substrate comprises application of 1H,1H,2H-perfluoro-1-dodecene ($C_{10}F_{21}$—CH═$CH_2$) by plasma-enhanced vapor deposition.

In one or more embodiments, the method for applying structural colors to a substrate of the present invention includes any one or more of the above referenced embodiments of the first aspect of the present invention wherein the hydrophobic and/or oleophobic coating is hydrophobic, superhydrophobic, or a combination thereof. In some embodiments, the method for applying structural colors to a substrate of the present invention includes any one or more of the above referenced embodiments of the first aspect of the present invention wherein the substrate is white. In one or more embodiments, the method for applying structural colors to a substrate of the present invention includes any one or more of the above referenced embodiments of the first aspect of the present invention wherein the substrate changes colors at elevated temperatures obscuring or changing the appearance of the structural color produced thereon.

In various embodiments, the method for applying structural colors to a substrate of the present invention includes any one or more of the above referenced embodiments of the first aspect of the present invention wherein said plurality of nanoparticles comprises melanin, polydopamine (PDA), silica ($SiO_2$), calcium carbonate, carbon black, polymers, polystyrene, poly(methyl methacrylate), metals, silver, gold metal oxides, $TiO_2$, alumina, iron oxides; core-shell particles, core-shell particles comprising melanin or polydopamine (PDA) and silica ($SiO_2$), or combinations thereof. In one or more embodiments, the method for applying structural colors to a substrate of the present invention includes any one or more of the above referenced embodiments of the first aspect of the present invention wherein said plurality of nanoparticles comprises melanin or polydopamine (PDA).

In various embodiments, the method for applying structural colors to a substrate of the present invention includes any one or more of the above referenced embodiments of the first aspect of the present invention wherein said plurality of nanoparticles comprises core-shell nanoparticles having a $SiO_2$ shell and a melanin or PDA core.

In one or more embodiments, the method for applying structural colors to a substrate of the present invention includes any one or more of the above referenced embodiments of the first aspect of the present invention wherein said plurality of nanoparticles comprises a core-shell nanoparticles having a $SiO_2$ shell and a melanin or PDA core and at least one other type of nanoparticles having a different diameter, structure, or chemistry. In some embodiments, the method for applying structural colors to a substrate of the present invention includes any one or more of the above referenced embodiments of the first aspect of the present invention wherein said plurality of nanoparticles have diameters of from about 40 nm to about 500 nm.

In one or more embodiments, the method for applying structural colors to a substrate of the present invention includes any one or more of the above referenced embodiments of the first aspect of the present invention wherein the concentration of said plurality of nanoparticles in the structural color forming suspension is from 0.5% w/v to about 10% w/v.

In various embodiments, the method for applying structural colors to a substrate of the present invention includes any one or more of the above referenced embodiments of the first aspect of the present invention wherein the step of placing said structural color forming suspension on said substrate comprises printing, spraying, brush coating, or roll coating. In some embodiments, the method for applying structural colors to a substrate of the present invention includes any one or more of the above referenced embodiments of the first aspect of the present invention wherein the step of allowing the solvent to evaporate takes place at a temperature of from about 30° C. to about 90° C.

In some embodiments, the method for applying structural colors to a substrate of the present invention includes any one or more of the above referenced embodiments of the first aspect of the present invention further comprising laminating the structural color with a transparent plastic, synthetic rubber, natural rubber, or elastomer material to protect the structural color from damage. In one or more embodiments, the method for applying structural colors to a substrate of the present invention includes any one or more of the above referenced embodiments of the first aspect of the present invention wherein the structural color produced may be estimated from their reflectance spectra and chromaticity diagrams.

In a second aspect, the present invention is directed to a method for printing a color image on a substrate using structural colors comprising: treating a surface of a substrate with a hydrophobic and/or oleophobic coating; preparing one or more structural color forming suspensions each comprising a carrier solvent and a plurality of nanoparticles known to form a particular structural color upon evaporation of the carrier solvent; loading said one or more structural color forming suspensions into a printer configured to apply said one or more structural color forming suspensions to the treated surface of said substrate at predetermined locations on the treated surface of said substrate to form a desired image; printing the one or more structural color forming suspensions at predetermined locations on the treated surface of said substrate; allowing said one or more carrier solvents to evaporate at a temperature of from about 30° C. to about 90° C. to form the desired image from the structural colors produced by said one or more structural color forming suspensions upon evaporation of the one or more carrier solvents.

In one or more embodiments, the method for printing a color image on a substrate of the present invention includes any one or more of the above referenced embodiments of the second aspect of the present invention wherein the step of preparing one or more suspensions comprises preparing three or more structural color forming suspensions each comprising a carrier solvent and a plurality of nanoparticles known to form a particular structural color upon evaporation of the solvent and the step of loading comprises loading said three or more structural color forming suspensions into said printer. In one or more embodiments, the method for printing a color image on a substrate of the present invention includes any one or more of the above referenced embodiments of the second further comprising laminating the image formed from the particular structural colors produced by said two or more suspensions upon evaporation of the solvent with a transparent plastic, natural or synthetic polymer, and/or elastomer material. In one or more embodiments, the method for printing a color image on a substrate of the present invention includes any one or more of the above referenced embodiments of the second wherein the step of treating comprises applying 1H,1H,2H-perfluoro-1-dodecene ($C_{10}F_{21}$—CH═$CH_2$) by plasma-enhanced vapor deposition.

In a third aspect, the present invention is directed to a method for printing a color image using structural colors comprising: treating a surface of a substrate by applying 1H,1H,2H-perfluoro-1-dodecene ($C_{10}F_{21}$—CH═$CH_2$) by plasma-enhanced vapor deposition; preparing one or more structural color forming suspensions each comprising a carrier solvent and a plurality of core-shell nanoparticles having a $SiO_2$ shell and a melanin or PDA core known to form a particular structural color upon evaporation of the carrier solvent; loading said one or more structural color forming suspensions into a printer configured to apply said one or more structural color forming suspensions to the treated surface of said substrate at predetermined locations on the treated surface of said substrate to form a desired image; printing the one or more structural color forming suspensions at predetermined locations on the treated surface of said substrate; allowing said one or more carrier solvents to evaporated at a temperature of from about 30° C. to about 90° C. to form the desired image from the structural colors produced by said one or more structural color forming suspensions upon evaporation of the one or more carrier solvents. In one or more of these embodiments, the method further comprises laminating the image formed from the particular structural colors produced by said two or more suspensions upon evaporation of the solvent with a transparent plastic, natural or synthetic polymer, and/or elastomer material. In some embodiments, at least one of said one or more structural color forming suspensions further comprises a dark absorber and/or a plurality of $SiO_2$ nanoparticles.

BRIEF DESCRIPTION OF THE DRAWINGS

For a more complete understanding of the features and advantages of the present invention, reference is now made to the detailed description of the invention along with the accompanying figures in which:

(FIG. 24B), to illustrate an indirect effect of temperature on structural colors by changing the background contrast.

Figure 1:
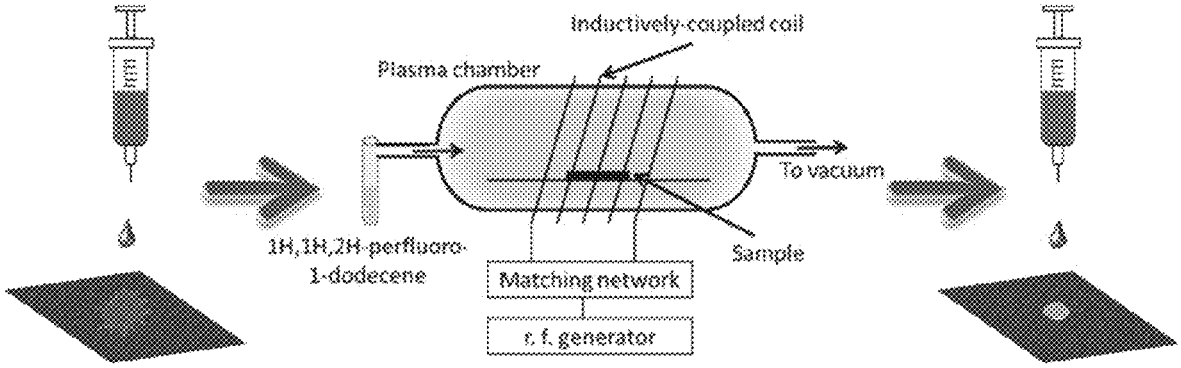
FIG. 1 is a schematic diagram showing the before- and after-effects of substrate surface treatment using the cold-plasma approach on drop deposition of colloidal suspensions.

The patent or application file contains at least one drawing executed in color. Copies of this patent or patent application publication with color drawing(s) will be provided by the Office upon request and payment of the necessary fee.

DETAILED DESCRIPTION OF THE ILLUSTRATIVE EMBODIMENTS

The following is a detailed description of the disclosure provided to aid those skilled in the art in practicing the present disclosure. Those of ordinary skill in the art may make modifications and variations in the embodiments described herein without departing from the spirit or scope of the present disclosure. Unless otherwise defined, all technical and scientific terms used herein have the same meaning as commonly understood by one of ordinary skill in the art to which this disclosure belongs. The terminology used in the description of the disclosure herein is for describing particular embodiments only and is not intended to be limiting of the disclosure.

As set forth above, in one or more embodiments, the present invention provides a method of applying or printing structural colors to a substrate that involves pre-treatment of the substrate surface to prevent absorption of the fluid containing the structural color forming particles by the substrate and confining it to the discrete area where the fluid has been applied or printed. While the pre-treatment may be done in a variety of ways, application of a hydrophobic or superhydrophobic coating, like 1H-IH,2H-perfluoro-1-dodecene ($C_{10}F_{21}$—CH═$CH_2$) (perfluoro) monomer, by plasma-enhanced chemical vapor deposition (cold plasma treatment) has been found to be effective, particularly for printing applications. In various embodiments, this cold plasma treatment of the substrate surface has been found to be simple and efficient, making it ideal for printing, and to allow droplets of colloidal suspension to adhere strongly (making a hydrophobic contact angle) and facilitate the self-assembly of the particles in the confined space into semi-ordered structures to yield structural colors. Advantageously, the pre-treatment also reduces or prevents the coffee ring effect (a ring-like pattern formed due to segregation of the particles towards the edge of the printed droplet as the water evaporates), without having to resort to the highly concentrated particle suspensions currently used, further reducing costs. In various embodiments, these methods also allow for the production of a wide gamut of non-iridescent colors by using binary mixtures of particles and for better printing on white backgrounds, features not readily observed in majority of the structural color systems. In some other embodiments, the methods of the present invention also allow for apply or printing structural colors having wavelengths outside the visible range for use in applications like security, anti-counterfeiting operations, and/or obscurant applications.

The following terms may have meanings ascribed to them below, unless specified otherwise. As used herein, the terms "comprising" "to comprise" and the like do not exclude the presence of further elements or steps in addition to those listed in a claim. Similarly, the terms "a," "an" or "the" before an element or feature does not exclude the presence of a plurality of these elements or features, unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein in the specification and the claim can be modified by the term "about."

It should be also understood that the ranges provided herein are a shorthand for all of the values within the range and, further, that the individual range values presented herein can be combined to form additional non-disclosed ranges. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50.

All publications, patent applications, patents, and other references mentioned herein are expressly incorporated by reference in their entirety, which means that they should be read and considered by the reader as part of this text. That the document, reference, patent application, or patent cited in this text is not repeated in this text is merely for reasons of conciseness. In the case of conflict, the present disclosure, including definitions, will control. All technical and scientific terms used herein have the same meaning.

Further, any compositions or methods provided herein can be combined with one or more of any of the other compositions and methods provided herein. The fact that given features, elements or components are cited in different dependent claims does not exclude that at least some of these features, elements or components maybe used in combination together.

In a first aspect, the present invention is directed to a method for applying structural colors to a substrate comprising treating a substrate with a hydrophobic and/or oleophobic coating, preparing a suspension comprising a solvent and a plurality of nanoparticles known to form a structural color upon evaporation of the solvent, applying or printing the suspension on said substrate and allowing the solvent to evaporate causing the nanoparticles organize to produce a structural color on said substrate.

In various embodiments, the method for applying structural colors of the present invention permits applying or printing structural colors on any substrate that has been treated as described below. The types of substrates that may be used for the method of the present invention are not particularly limited, and suitable substrates may include, without limitation, paper, cardboard, woods, plastics, metals, steel, aluminum, textiles, rubbers, elastomers, glass, or combinations thereof.

As will be appreciated by those of ordinary skill in the art, the color of the substrate can affect the color of the structural color that is displayed on the substrate. However, the substrates used may be any color, but as set forth above, the color of the substrate may affect the color that is displayed thereon. In some embodiments, the substrate may be black. As will be apparent, a black substrate allows for a better contrast, enhancing the structural color. In some other embodiments, the substrate may be white.

In some other embodiments, the substrate may be loaded with temperature sensitive materials such as thermochromic or photochromic microcapsules, to change color at different temperatures or wavelengths. In some of these embodiments, thermochromic microcapsules a temperature-responsive material that changes from white to black on cooling from room temperature to 15° C. dispersed in an epoxy resin matrix may be used. In some other embodiments, photochromic microcapsules a wavelength-responsive material that changes from white to black on white light to UV light dispersed in an epoxy resin or similar matrix may be used may be used. The temperature sensitive load is mixed before the treatment of the surface and the colors are applied. In these embodiments, images or messages formed from structural colors can be made to appear and disappear at different temperatures.

In various embodiments, the concentration of the thermochromic or photochromic microcapsules in the resin in these embodiments is not particularly limited and may be from about 0.2 wt % to about 5 wt %. In some of these embodiments, concentration of the thermochromic or photochromic microcapsules in the epoxy resin is about 1.5 wt %.

Once the substrate has been selected, it is treated with a hydrophobic and/or oleophobic coating that keeps the suspension containing the structural color particles from being absorbed into the substrate and keeps the droplets of fluid where they are placed on the substrate. In various embodiments, the materials applied to the substrate will form a highly hydrophobic and/or oleophobic, preferably superhydrophobic and/or superoleophobic, coating on the substrate. As used herein, the term "hydrophobic" refers to a coating, surface, or material that tends to repel or fails to mix with water, and the term "superhydrophobic" refers to a coating, surface, or material that is highly hydrophobic, having a water contact angle of greater than 150 degrees and a sliding angle of less than 10 degrees. Similarly, as used herein, the term "oleophobic" refers to a coating, surface, or material that is tends to repel or fails to mix with oils or other polar materials. In some embodiments, the treated substrate may be both hydrophobic and oleophobic. In some other embodiments, the treated substrate may be both superhydrophobic and oleophobic.

In one or more embodiments, the treated substrate will have a having water contact angle of 100° or more, as measured by water contact angle testing. In some embodiments, the treated substrate will have a having water contact angle of 105° or more, in other embodiments, 110° or more, in other embodiments, 115° or more, in other embodiments, 120° or more, in other embodiments, 125° or more, in other embodiments, 130° or more, in other embodiments, 135° or more, in other embodiments, 140° or more, in other embodiments, 145° or more, and in other embodiments, 150° or more. In some embodiments, treated substrate will have a having water contact angle of 130° or more.

The materials applied to the substrate to form the hydrophobic and/or oleophobic coating is not particularly limited provided that it forms a coating that is hydrophobic and/or oleophobic as described above with respect to the structural color forming fluid being applied, is compatible (i.e. non-reactive) with the substrate and the structural color forming fluid being applied, does not affect the color displayed by the applied structural colors. As will be apparent, the structural color forming fluid will be a colloidal suspension comprising a carrier solvent and a plurality of nanoparticles that will organize to produce the nanostructures that produce the structural colors. In various embodiments, the materials applied to treat the substrate will be hydrophobic and/or oleophobic with respect to the carrier solvent used in the structural color forming fluid. If the carrier solvent is water, for example, the material coating the substrate would be hydrophobic, and more preferably superhydrophobic. Conversely, if the carrier solvent is oil based (e.g., a non-polar solvent), the material coating the substrate would be oleophobic. In some embodiments, the material used to coat the substrate may be both hydrophobic or superhydrophobic and oleophobic. In some embodiments, the materials applied to the substrate to form the hydrophobic and/or oleophobic coating is clear. Suitable material for treating the substrate include, without limitation, 1H-IH,2H-perfluoro-1-dodecene ($C_{10}F_{21}$—CH═$CH_2$) (perfluoro) monomer, fluoroalkyls, fluorohydroalkyls, cyclo-fluoroalkyls, fluorobenzenes, or a combination thereof.

In various embodiments, the thickness of the hydrophobic and/or oleophobic coating is not particularly limited. In most cases, the hydrophobic and/or oleophobic coating will be just a few nanometers thick and colorless. In various embodiments, the hydrophobic and/or oleophobic coating will be from about 5nm to about 100 nm thick. In some embodiments, the hydrophobic and/or oleophobic coating will be from about 5nm to about 80 nm, in other embodiments, from about 5 nm to about 60 nm, in other embodiments, from about 5 nm to about 40 nm, in other embodiments, from about 5 nm to about 20 nm, in other embodiments, from about 10 nm to about 100 nm, in other embodiments, from about 30 nm to about 100 nm, in other embodiments, from about 50 nm to about 100 nm, and in other embodiments, from about 70 nm to about 100 nm thick.

The method used to treat the substrate is not particularly limited and suitable methods may include, without limitation, plasma-enhanced vapor deposition, layer-by-layer polymer coating, spin coating, and solvent casting. One of ordinary skill in the art will be able to apply the hydrophobic and/or oleophobic coating to the substrate without undue experimentation. In various embodiments, the substrate is treated by plasma-enhanced vapor deposition (cold plasma treatment). Plasma-enhanced vapor deposition is well known in the art and FIG. 1 shows a representative apparatus for use in plasma-enhanced vapor deposition, also referred to herein as cold plasma treatment. In this process, thin films of various materials can be deposited on substrates at a lower temperature than standard Chemical Vapor Deposition (CVD). In plasma-enhanced vapor deposition, a thin film of material is deposited onto the substrate by introducing a reactant gas or vapor (containing the materials to be deposited) between a grounded electrode and an RF-energized electrode. The capacitive coupling between the electrodes excites the gases into a plasma, which induces a chemical reaction and results in the material being deposited on the substrate. Because the plasma provides some of the energy for the deposition reaction to take place, the process can be done at atmospheric pressure and at lower processing temperatures compared with purely thermal processing methods of CVD, making it more suitable to large-scale industrial production.

Figure 2A:
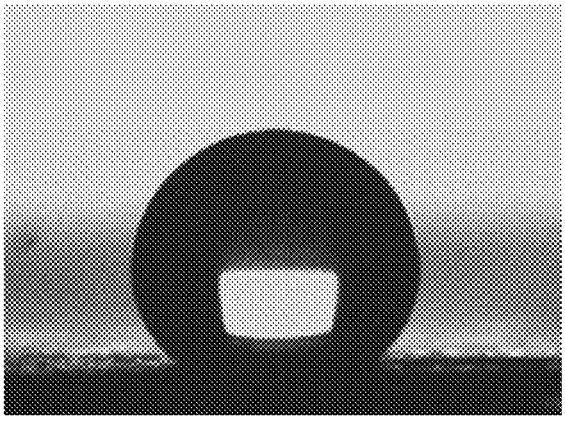
FIGS. 2A-B are images showing (FIG. 2A) the contact angle of a colloidal suspension on a hydrophobic surfaced formed by the cold plasma treatment using perfluoro as a monomer and (FIG. 2B) confinement of particles to small spots to initiate the self-assembly process to form colloidal arrays; (scale bar 1 mm).
Figure 2B:
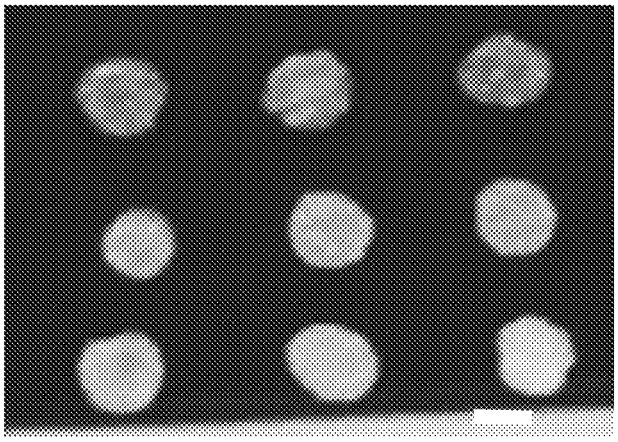

In various embodiments, the substrate is treated plasma-enhanced vapor deposition (cold plasma treatment) using 1H-IH,2H-perfluoro-1-dodecene ($C_{10}F_{21}$—CH═$CH_2$) (perfluoro) monomer. By way of example, 1H,IH,2H-perfluoro-1-dodecene ($C_{10}F_{21}$—CH═$CH_2$) (97% pure) (perfluoro) monomer was applied to a substrate by plasma-enhanced vapor deposition, as shown in FIG. 1, to produce a hydrophobic and an oleophobic surface having water contact angles higher than 130° (FIG. 2A), allowing the confinement of particles in a small area when the solvent is evaporated (FIG. 2B). Also, it was found that the droplets are highly adhesive to the paper and do not simply roll-off. Further, as shown in FIG. 2B, the addition of small volumes (2 μL) of an aqueous suspension of narrow size-distribution nanoparticles (NPs) on a highly hydrophobic surface followed by the evaporation of the carrier solvent (in this case water), allows the formation of crystalline domains (photonic crystals). Structural colors arise from the interaction of light with these domains. Depending on the size of the particle, it is possible to have different colors; for this specific case, silica ($SiO_2$) particles of sizes 220, 260 and 300 nm will produce blue, green and red colors, respectively.

Once the hydrophobic and/or oleophobic has been applied to the substrate, one or more structural color forming fluids or inks may be applied or printed onto the substrate at desired locations as is known in the art. As used herein, the terms "structural color forming fluid," "fluid containing the structural color forming particles," "structural color forming liquid," "liquid containing the structural color forming particles," "structural color forming suspension," "structural color forming colloidal suspension," and "colloidal suspension" are used interchangeably to refer to a colloidal suspension used to apply a structural color to a substrate comprising a carrier solvent and a plurality of particles, generally nanoparticles, known to form structural colors upon evaporation of the carrier solvent. Similarly, the terms "structural color forming ink," "ink containing the structural color forming particles," are used interchangeably to refer to a structural color forming fluid, as defined above, configured to be applied to a substrate by printing. While the invention is described below primarily in terms of binary systems of silica nanoparticles and melanin or PDA or silica/PDA core shell nanoparticles and melanin or PDA, the invention is not so limited and other systems and combinations of nanoparticles known in the art may be used.

As used herein, the terms "structural color producing nanoparticles" and "structural color producing particles," "structural color forming nanoparticles" and "structural color forming particles" are used interchangeably to refer to particles or nanoparticles known to organize to form a structural color upon evaporation of the carrier solvent. In various embodiments, any type of structural color producing nanoparticles known to organize to form a structural color upon evaporation of the carrier solvent may be used. In one or more embodiments, the structural color forming nanoparticles will include, without limitation, colloidal particles made of $SiO_2$, polydopamine (PDA), $TiO_2$, alumina, metals (silver, gold), polymers (polystyrene, poly(methyl methacrylate)), core-shell particles (cores and shells can be made of materials listed above), or mixtures thereof.

In various embodiments, structural color producing nanoparticles may include dark (black) materials for absorbing light, including, without limitation carbon black melanin, and polydopamine (PDA). As will be appreciated by those of skill in the art, carbon black is one of the most commonly used and studied materials for absorbing incoherent scattering of light from the colloidal arrays fabricated using white nanoparticles (e.g. silica, polystyrene, etc.). In some embodiments, the structural color producing nanoparticles may include polydopamine (PDA)—a synthetic mimic of the ubiquitous natural pigment melanin, which nontoxic. PDA's facile synthesis protocol, easy control over size distribution and its broad-band absorption behavior in the ultraviolet (UV) and visible spectrum makes PDA an excellent candidate for these materials.

It has been found that a wide range of colors can be achieved by using different sizes of particles. In various embodiments, the structural color producing nanoparticles will be from about 40 nm to about 500 nm in diameter at their widest point. In some embodiments, the structural color producing nanoparticles will be from about 40 nm to about 400 nm, in other embodiments, from about 40 nm to about 300 nm, in other embodiments, from about 40 nm to about 200 nm, in other embodiments, from about 40 nm to about 100 nm, in other embodiments, from about 50 nm to about 400 nm, in other embodiments, from about 100 nm to about 400 nm, in other embodiments, from about 200 nm to about 400 nm, in other embodiments, from about 250 nm to about 400 nm, and in other embodiments, from about 300 nm to about 400 nm in diameter at their widest point. In some embodiments, the structural color producing nanoparticles will be from about 200 nm to about 300 nm in diameter. It has been found that the application of relatively small volumes of a structural color forming fluid containing a narrow size-distribution of structural color forming nanoparticles on a substrate treated as described above, followed by the evaporation of the carrier solvent, allows the formation of crystalline domains (photonic crystals). As set forth above, structural colors arise from the interaction of light with these domains. Depending on the size of the particle, it is possible to have different colors, for example, silica ($SiO_2$) particles of sizes 220, 260 and 300 nm will produce blue, green and red colors, respectively.

In one or more embodiments, the structural color forming nanoparticles may be core shell particles having PDA or melanin cores and $SiO_2$ shells. In one or more embodiments, core shell particles having PDA or melanin cores and $SiO_2$ shells may be made as set forth in U.S. Published Application No. 2019/0275491 A1, the disclosure of which is incorporated herein by reference in its entirety. In some embodiments, structural color forming nanoparticles may be solid $SiO_2$ nanoparticles. In some embodiments, structural color forming nanoparticles may be hollow nanoparticles with a PDA shell.

In one or more embodiment, structural color forming liquid will contain a first type of core shell particles having a core-shell structure where either PDA or melanin forms the core and $SiO_2$ forms the shells and second type of structural color forming nanoparticle having different diameter, structure, or chemistry. In some of these embodiments, the second type of structural color forming nanoparticle used to form the structural color forming liquid may comprise a dark absorber like melanin, PDA, or carbon black. In some embodiments, the second type of structural color forming nanoparticle may be a solid $SiO_2$ nanoparticle. In some embodiments, the second type of structural color forming nanoparticle may be a core-shell nanoparticle having a different diameter and/or composition. In some other embodiments, the structural color forming liquid will contain solid $SiO_2$ nanoparticles and melanin or PDA as a dark absorber. In some other embodiments, the structural color forming liquid may contain three or more different types of nanoparticles.

Figure 3A:
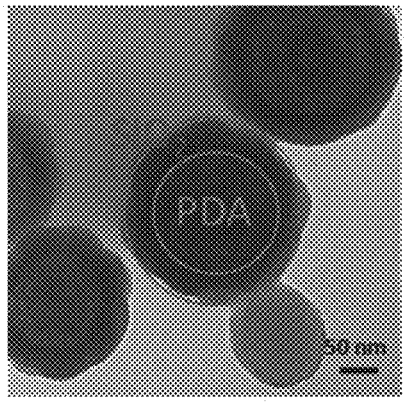
FIGS. 3A-B are a transmission electron microscope (TEM) image of core-shell particles—PDA@$SiO_2$ 160/36 (FIG. 3A), and an image showing the color it produces when its aqueous suspension is applied on a perfluorinated black paper, scale bar 50 μm (FIG. 3A).
Figure 3B:
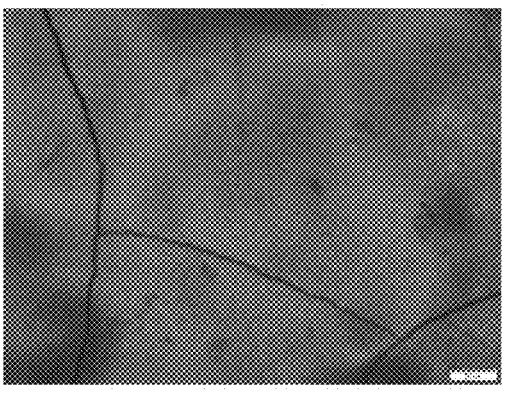
Figure 4A:
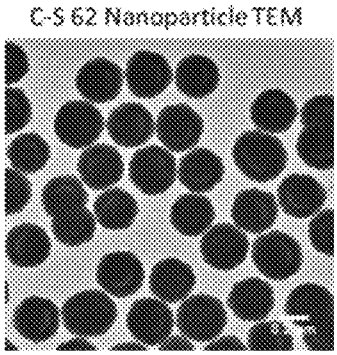
FIGS. 4A-C are a TEM (200 nm scale bar) (FIG. 16A), a SEM (1 μm scale bar) (FIG. 4B) and optical images (100 μm scale bar) (FIG. 4C) of the CS-62 nanoparticle.
Figure 4B:
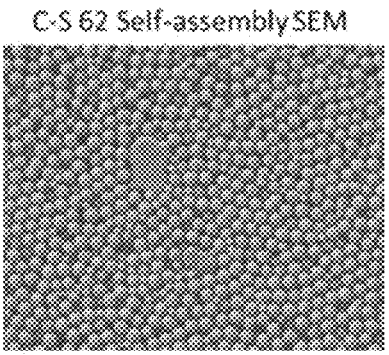
Figure 4C:
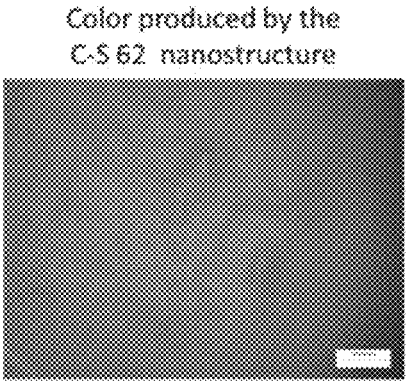
Figure 5A:
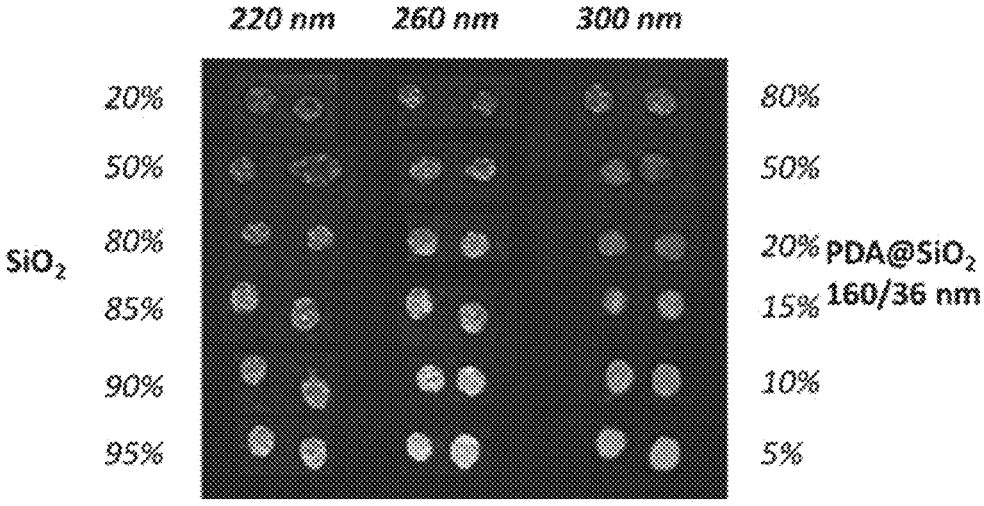
FIGS. 5A-B is an image showing printed structural color dots (scale bar 1 mm) of varying proportions of the core-shell and $SiO_2$ particles (FIG. 5A) with their corresponding optical images (FIG. 5*b*), scale bars are 50 μm.
Figure 5B:
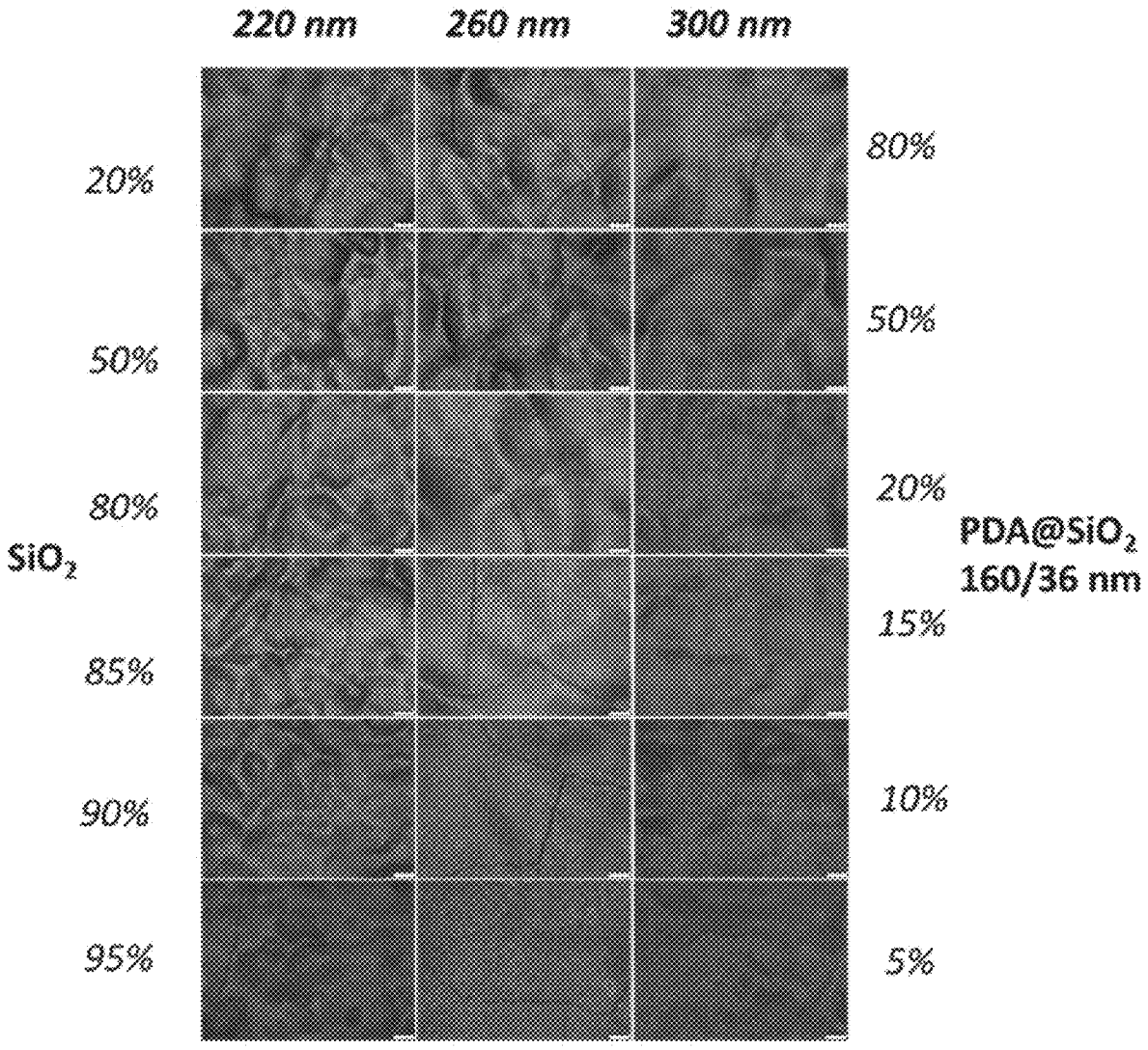

To illustrate this, a binary mixture containing a core-shell particle composed of a PDA core and a $SiO_2$ shell (which can be tuned for exhibiting more colors) and $SiO_2$ particles was prepared and tested. In some of these experiments, particles with a core diameter of 160 nm and a shell thickness of 36 nm (PDA@$SiO_2$ 160/36) (FIG. 3A), originally producing a particular color as shown in FIG. 3B and a core diameter of 160 nm and a shell thickness of 62 nm (PDA@$SiO_2$ 160/62) (FIG. 4A-B), originally producing a particular color as shown in FIG. 4-C, were used as one of the components of the binary mixtures to produce a gamut of colors. As shown in FIG. 5A, it was found that the combination of these core-shell particles with $SiO_2$ nanoparticles exhibited a color different from those observed from the colloidal arrays prepared using individual types of particles. Advantageously, it has been found that a wide gamut of colors can be produced by simply mixing different proportions of the core-shell and solid $SiO_2$ types of particles and enabling them to self-assemble at confined spots (See, FIG. 5B).

Figure 6A:
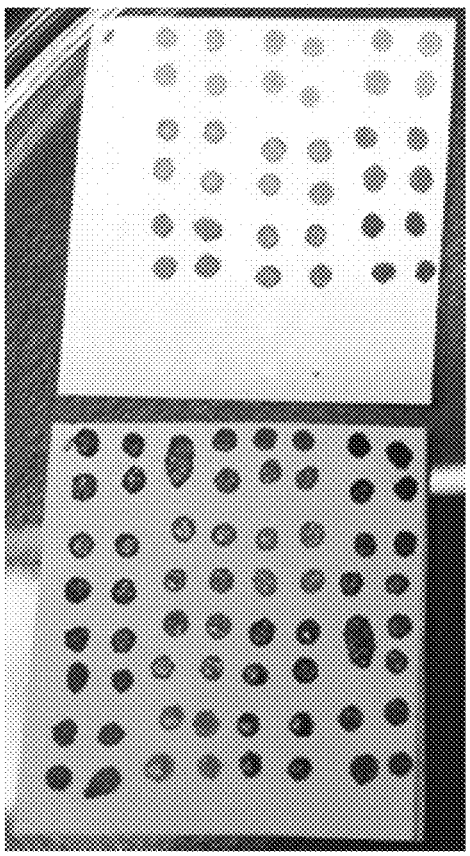
FIGS. 6A-B in an image showing binary mixtures of PDA-$SiO_2$ NPs (top) and, binary mixtures of PDA@$SiO_2$ 160/36 and $SiO_2$ NPs (bottom) on perfluorinated white paper (FIG. 6A) and a hand-made "Luigi" made using a combination of only PDA-$SiO_2$ NPs (first drawing made) (left) and the target image (right) (FIG. 6B).
Figure 6B:
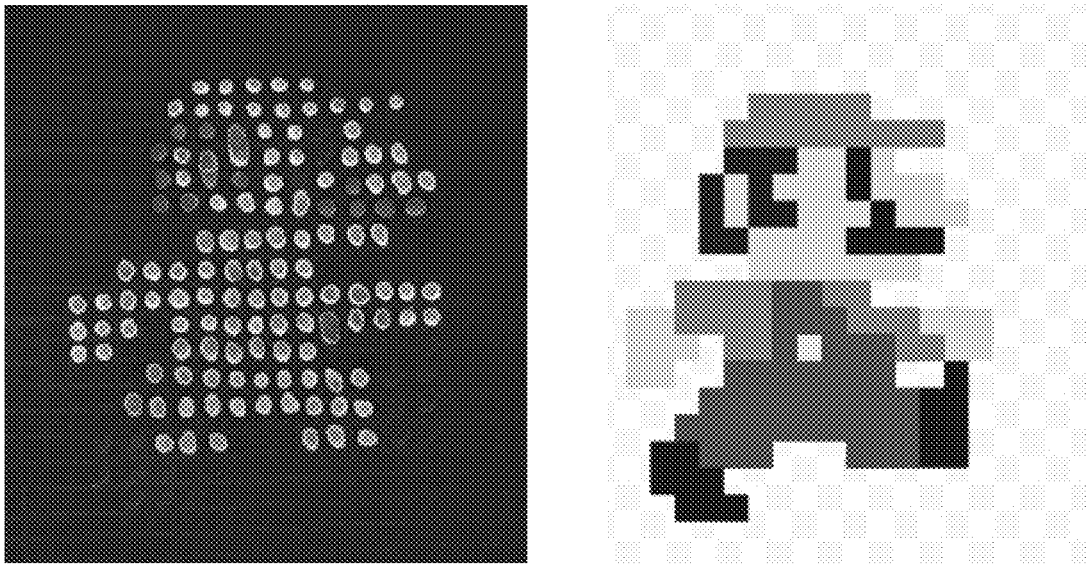

As set forth above, structural colors are generally observed better on black paper because high incoherent scattering that these nanostructures generate with light is absorbed by the black paper, giving an enhancement in the color production. The methods of the present invention and the binary mixture system described above allows for improved printing of structural colors on white paper (FIG. 6A). It has been found that the cold-plasma treatment of paper and the presence of PDA particles produces enhanced colors on a white background. The generation of these small dots (considered as pixels), are the building units to produce full color images as can be seen in FIG. 6B. Depending on the dot size, the resolution of these types of printed images can be improved.

As set forth above, in some embodiments, a binary system of different types of structural color forming nanoparticles is used to produce a wide array of colors simply by varying the ratio of the two types of nanoparticles. In one or more of these embodiments, the type and the proportion of the particles in a binary mixture that produces a certain color can be estimated from their reflectance spectra and chromaticity diagrams. As will be understood by those of ordinary skill in the art, the reflectance spectra are experimentally measured using a micro-spectrophotometer that provides data as a plot of reflectance as a function of wavelength. These reflectance spectra, for each type of binary mixture, were used to get the x and y co-ordinates on the chromaticity diagram constructed according to a standard CIE 1931 laid down by the International Commission on Illumination or Commission Internationale de l'Elcairage (CIE), the disclosure of which is incorporated herein by reference in its entirety. It is believed that the predictability of these systems will greatly facilitate the design of structural color fluids and inks for printing and other applications.

Figure 7A:
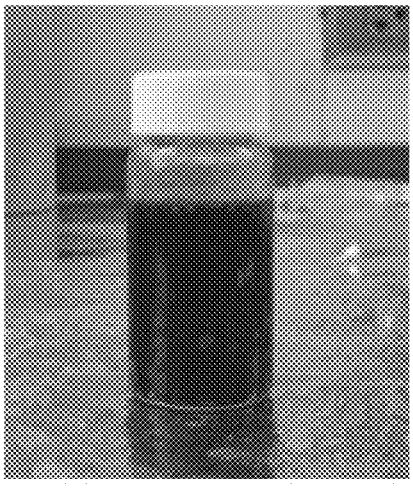
FIGS. 7A-B are (FIG. 7A) an images of PDA particle dispersion in water and (FIG. 7B) the corresponding scanning electron microscope (SEM) images of the same PDA particle dispersion in water. Scale bar is 1 μm.
Figure 7B:
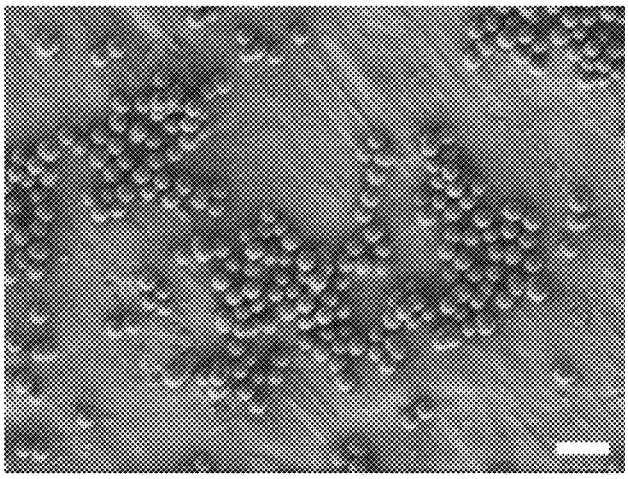
Figure 7C:
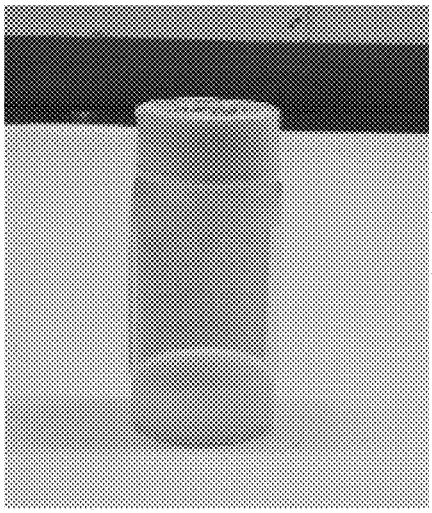
FIGS. 7C-D are an images of $SiO_2$ particle dispersion in water (FIG. 7C) and the corresponding scanning electron microscope (SEM) images of the same $SiO_2$ particle dispersion in water (FIG. 7D). Scale bar is 1 μm.
Figure 7D:
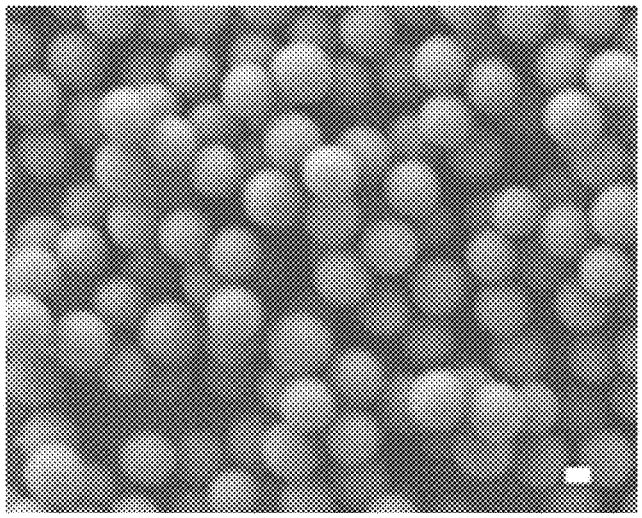
Figure 8A:
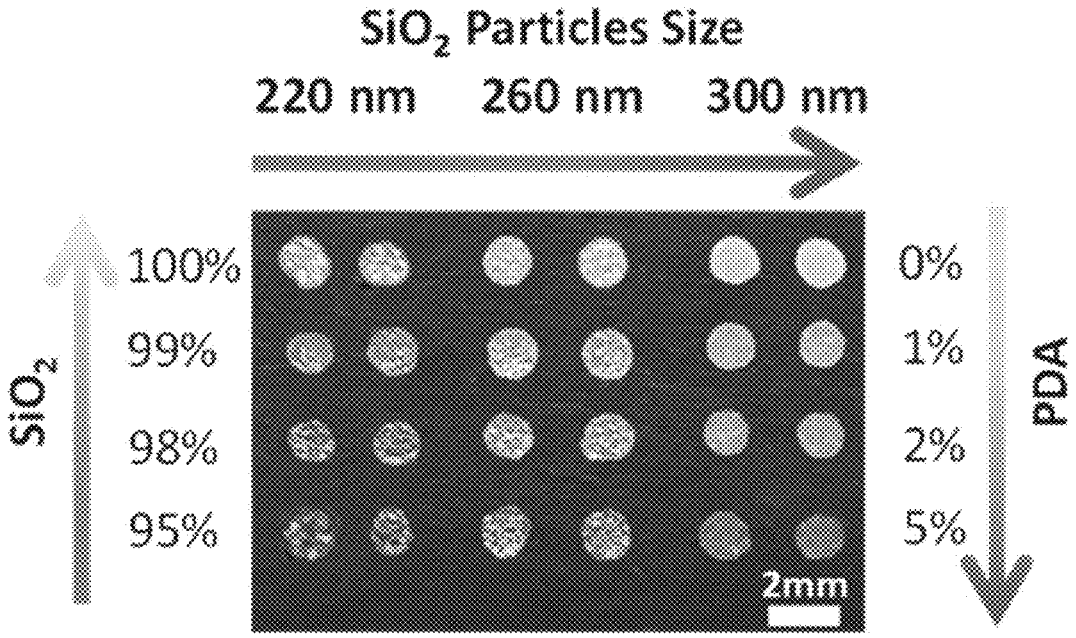
FIGS. 8A-B are photographs of the printed dots prepared using binary mixtures of $SiO_2$ and PDA particles by drop deposition; starting with pure $SiO_2$, followed by incorporation of 1%, 2% and 5% (wt %) PDA particles, scale bar 2 mm (FIG. 8A) and optical micrographs of the corresponding binary mixtures, scale bar 100 μm (FIG. 8B).
Figure 8B:
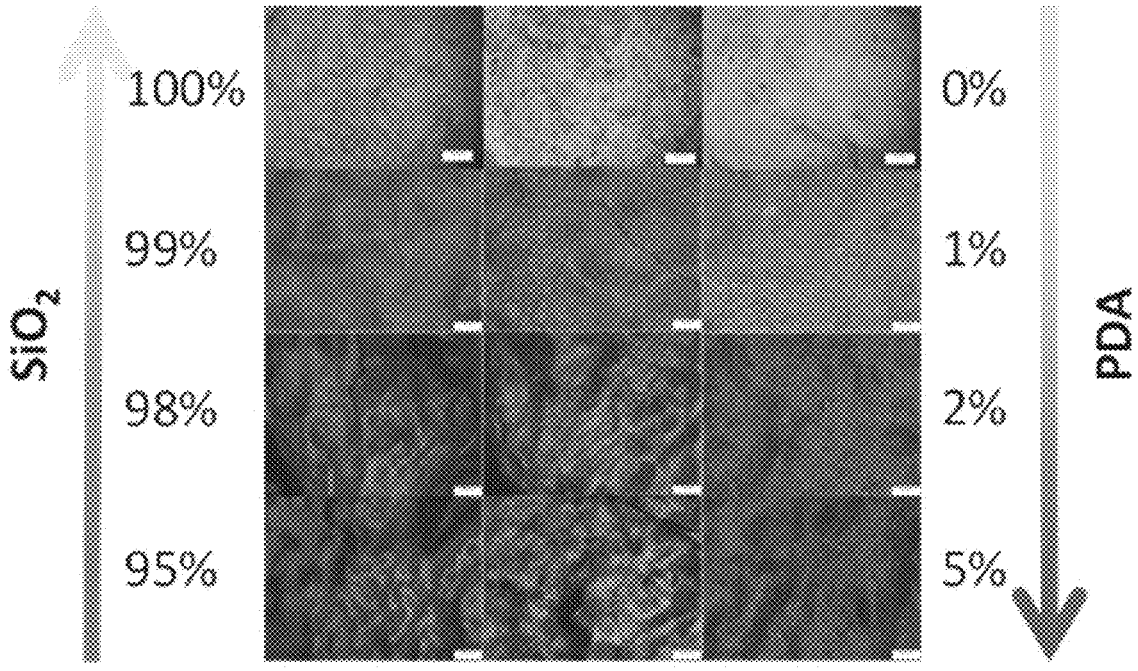

Similarly, it has been found that in systems using a binary mixture of PDA (dark absorber) (FIG. 7A-B) and $SiO_2$ nanoparticles (FIG. 7C-D) it is possible to control the brightness of the color by varying the relative amounts of PDA and $SiO_2$ nanoparticles as shown in FIGS. 8A-B. In these experiments, a 2 μL drop containing particles (2% w/v) was dropped onto a perfluorinated paper giving a dot size of ~2 mm diameter (FIGS. 8A-B). As mentioned earlier, the treatment of the substrate to render it hydrophobic confines the particles in a single spot, allowing for the use of low concentrated particle suspensions to produce structural colors than conventionally used highly concentrated systems.

In one or more embodiments, the structural colors produced by the methods of the present invention will produce structural colors within the visible spectrum, but the invention is not so limited. In other embodiments, the structural colors produced by the methods of the present invention may be used to produce patterns invisible to the human eye (having reflectance outside the visible spectrum) for use in anti-counterfeiting and other similar applications. In some of these embodiments, structural colors having reflectance outside the visible spectrum are applied or printed to a treated substrate in a recognizable pattern. In these embodiments, this pattern would not be visible under ordinary light, but may be detectable under infra-red or ultraviolet light.

In various embodiments, the concentration of structural colors forming nanoparticles in the structural color forming suspension will be from about 0.5% w/v to about 10% w/v. In some embodiments, the concentration of structural colors forming nanoparticles in the structural color forming suspension will be from about 0.5% w/v to about 8% w/v, in other embodiments, from about 0.5% w/v to about 6% w/v, in other embodiments, from about 0.5% w/v to about 4% w/v, in other embodiments, from about 0.5% w/v to about 2% w/v, in other embodiments, from about 1% w/v to about 10% w/v, in other embodiments, from about 2% w/v to about 10% w/v, in other embodiments, from about 4% w/v to about 10% w/v, in other embodiments, from about 6% w/v to about 10% w/v, and in other embodiments, from about 8% w/v to about 10% w/v.

Figure 9A:
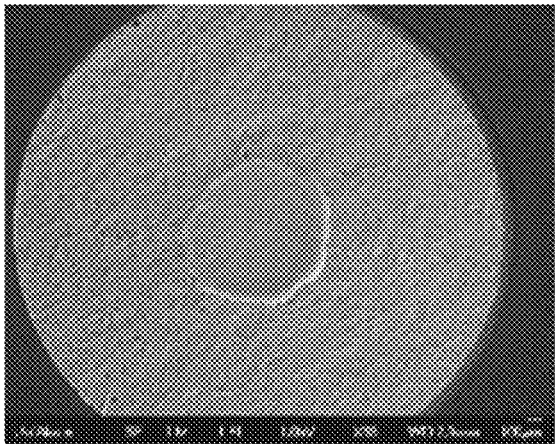
FIGS. 9A-C are an SEM image of the printed dot after complete evaporation of the solvent (FIG. 9A); an image of the fibers of the paper completely covered by the particles (FIG. 9BA); and a magnified image of particles occupying the conformity of a single fiber (FIG. 9CA). Scale bars are 100 μm (FIGS. 9A-B) and 10 μm (FIG. 9C).
Figure 9B:
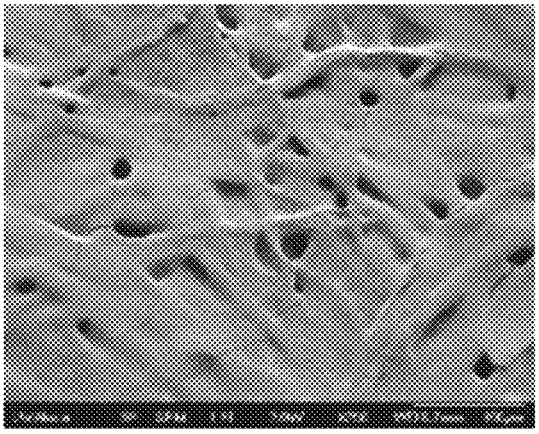
Figure 9C:
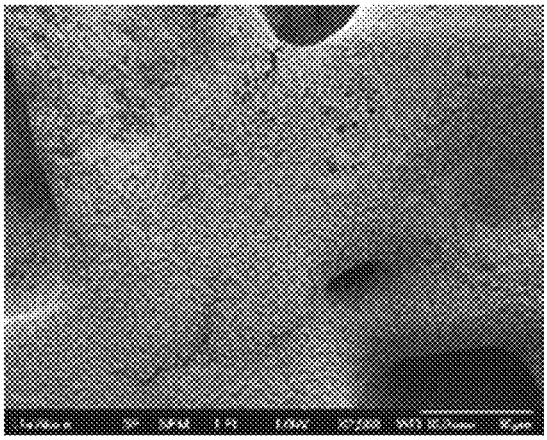

The method for applying the structural color forming fluid or ink to the substrate is not particularly limited, and suitable methods may include printing, spraying, spin coating, brush coating, roll coating, casting, or a combination thereof. Moreover, SEM images (FIGS. 9A-C) show how the particles occupy the paper completely when the aqueous suspension is added on it. The perfluorination treatment, described above, confines the particles in a small area, allowing the self-assembly to occur. The particles conform to the contour of the paper covering the entire span of area onto which the drop was introduced.

Advantageously, in various embodiments, the structural color forming fluid or ink described herein are suitable for printing applications. As set forth above, the particles used in various embodiments of the method of the present invention are in nanometric dimensions (~40 nm-~500 nm in size), which makes them suitable for use with very small printer nozzle sizes. Moreover, as mentioned earlier, the pre-treatment of the substrate to render it hydrophobic and/or oleophobic allows for the use of structural color forming liquids with much lower concentrations of structural color forming particles than is possible with conventionally systems since they prevent absorption of the structural color producing liquid into the substrate and confine it to the location where has been applied. Together these two advantages allow for the printing of structural colors with improved image resolution and quality because the method permits dispensing of much smaller droplets (tens of pL to hundreds of nL droplets) without clogging these printer nozzle heads. In various embodiments, printing can be done using different types of nozzles or using electrostatic methods.

The thickness of the drops in most of these embodiments is in the range of 10 to 20 μm, enough to produce scattering. Possible models to predict colors using parameters like size of the particles, thickness of the films, spacing among the particles, distribution of the two kinds of particles and the particle's arrangement is possible to construct.

As set forth above, one challenge in using these structural color systems is preventing or at least minimizing the "coffee ring effect" which poses considerable issues in terms of hampering the resolution of printed images and their quality. Analogous to a stain produced by the evaporated drop of coffee, during printing or other application process, coffee-ring patterns are produced by the accumulation of dispersed matter to the edge of the printed drop due to induced-capillary flows caused by the differential evaporation rates across the drop. Conventional structural color systems address this problem by using very high concentrations of particles in their structural color producing liquid to account for the particles that become absorbed into the substrate and to ensure there are sufficient particles for consistent color as the applied droplets spread out over the substrate or adding by chemicals like formamide and poly (ethylene glycol) (PEG) to improve binding between the particles.

As discussed above, the present method does not use the highly concentrated fluids or chemicals used in conventional methods. Instead, the method of the present invention addresses this coffee ring effect issue in two ways. First, treatment of the substrate as described above prevents the fluid from being absorbed by the substrate and the repulsive forces between the carrier solvent in the applied droplet and the hydrophobic and/or oleophobic coating on the substrate prevents the droplet from spreading out, effectively adhering it to the spot where it was dispensed. Second, the structural color forming fluid or ink is applied to the substrate at a slightly elevated temperature to speed up evaporation of the carrier solvent. In one or more embodiments, the structural color forming fluid or ink is applied to the substrate at temperature of from about 30° C. to about 90° C. In some embodiments, the structural color forming fluid or ink is applied to the substrate at temperature of from about 30° C. to about 80° C., in other embodiments, from about 30° C. to about 70° C., in other embodiments, from about 30° C. to about 60° C., in other embodiments, from about 30° C. to about 50° C., in other embodiments, from about 40° C. to about 90° C., in other embodiments, from about 50° C. to about 90° C., and in other embodiments, from about 60° C. to about 90° C. In some embodiments, the structural color forming fluid or ink is applied to the substrate at temperature of from about 60° C. to about 65° C. It has been found that by doing these things; the coffee ring effect can be greatly reduced or eliminated.

Figure 10A:
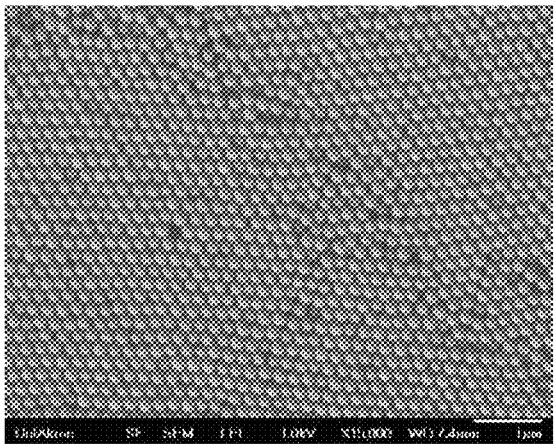
FIGS. 10-A-C SEM images of self-assembled structures formed by 220 nm $SiO_2$ NPs (FIG. 10A), binary mixtures of 98% $SiO_2$-2% PDA NPs (FIG. 10B) and, 95% $SiO_2$-5% PDA NPs (FIG. 10C) provided as an example of how PDA NPs disrupt the crystalline domains formed by the $SiO_2$ NPs. The Scales bars are 1 μm.
Figure 10B:
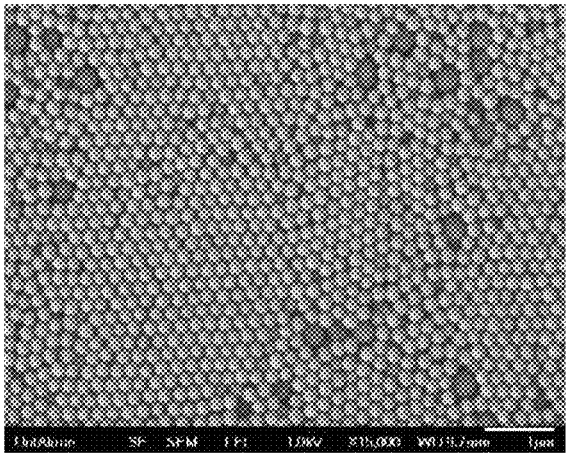
Figure 10C:
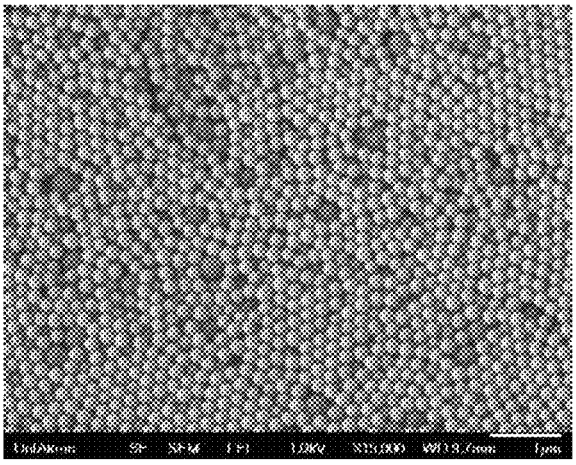

As set forth above, colloidal arrays forming crystalline domains are prone to show iridescent (angle-dependent) structural colors, as shown in FIG. 10A. As the solvent evaporates from the droplet on the treated substrate, self-assembly begins, building a long-range, periodic arrangement of monodisperse particles giving the angle-dependency behavior. By incorporating particles of different chemistry and size (like PDA ~330 nm in size), the growth of crystalline domains is impeded to give short-range, periodic arrangement (cutting down the sizes of crystalline domains) thereby, diminishing the angle-dependent behavior of the system (FIGS. 10-B-C).

Another challenge with in using these structural color systems is ensuring their durability, since disturbing the organization of the particles on the substrate will affect the color that is displayed. Stabilization of nanostructures (especially self-assembled particles) on the substrate is a challenge which has not been clearly addressed. Infusing some material through the supra-structure to maintain its structural integrity may alter the native color or simply eliminate it. To stabilize the nanostructures, the method of the present invention instead employs lamination techniques involving transparent plastics or elastomers on a printed pattern or other applied structural color to protect both the structural integrity of the supra-structure and the substrate, without affecting the structural color produced by the self-assembly.

EXAMPLES

The following examples are offered to more fully illustrate the invention, but are not to be construed as limiting the scope thereof. Further, while some of examples may include conclusions about the way the invention may function, the inventor do not intend to be bound by those conclusions, but put them forth only as possible explanations. Moreover, unless noted by use of past tense, presentation of an example does not imply that an experiment or procedure was, or was not, conducted, or that results were, or were not actually obtained. Efforts have been made to ensure accuracy with respect to numbers used (e.g., amounts, temperature), but some experimental errors and deviations may be present. Unless indicated otherwise, parts are parts by weight, molecular weight is weight average molecular weight, temperature is in degrees Centigrade, and pressure is at or near atmospheric.

Example 1

Figure 11A:
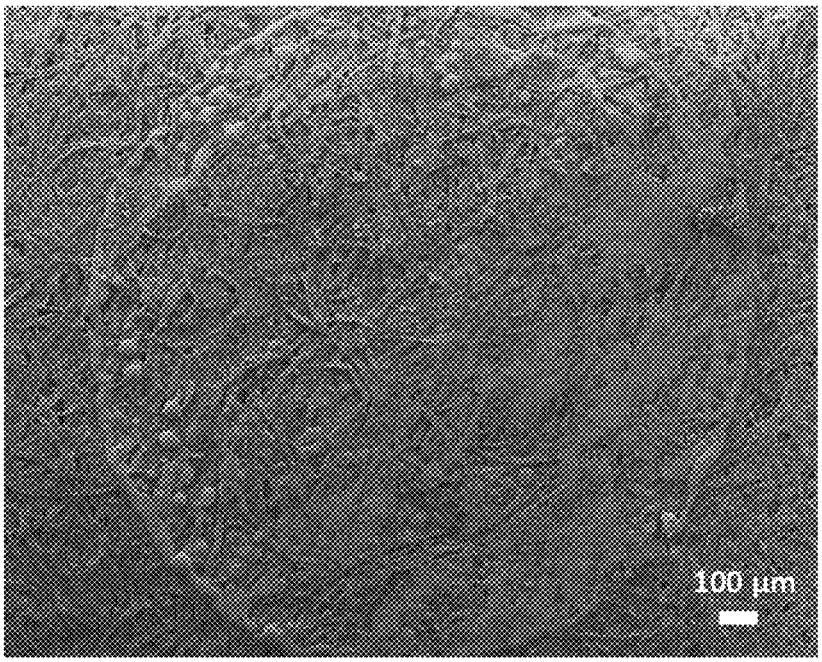
FIGS. 11A-B are SEM images of the resulting morphology from the drop deposition of colloidal suspensions on untreated (FIG. 11A) and treated (FIG. 11B) substrate surfaces can distinctly deduce the power of the cold-plasma treatment for favoring colloidal assemblies.
Figure 11B:
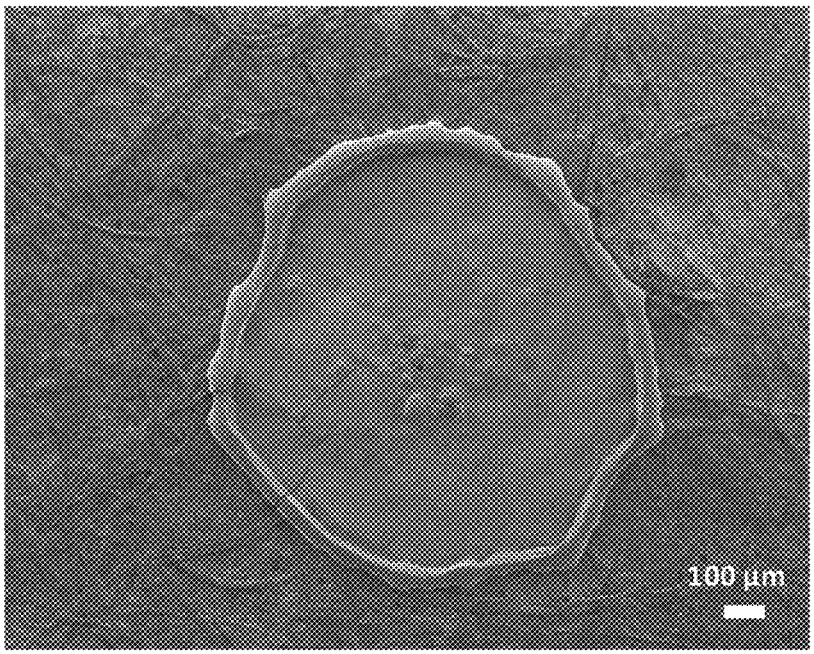

Preparation and Optical Properties of Printed Structural Colored Dots on Perfluoro Treated Substrates FIG. 1 illustrates the cold-plasma approach used to modify the surface of the substrate to enable assembly of nanoparticles from a colloidal suspension by drop deposition. In these experiments, paper substrates with and without a fluorinated monomer coating applied by plasma-enhanced vapor deposition of 1H,1H,2H-perfluoro-1-dodecene (perfluoro) were evaluated by drop deposition of an aqueous colloidal suspension. FIGS. 11A-Bare SEM images of the resulting morphology on the untreated (FIG. 11A) and the treated (FIG. 11B) substrate surfaces. As can be seen in FIG. 11A, when microliter (μL) droplets of colloidal suspension were released onto an untreated paper, the dispersion medium (i.e. water) was readily absorbed by the porosity of the paper due to capillary action, thereby impeding the particles from forming a colloidal nanostructure. The 1H,1H,2H-perfluoro-1-dodecene (perfluoro) was applied to the treated paper substrate by plasma-enhanced vapor deposition, as described above As set forth above, the fluorinated monomer, 1H,1H,2H-perfluoro-1-dodecene (perfluoro) yields a superhydrophobic and an oleophobic surface upon plasma polymerization on the substrate surface, giving water contact angles greater than 130°. As a consequence, the microliter droplets maintained their sessile drop shapes on the treated surfaces and as the water evaporated and the colloidal particles spontaneously assembled within the confined geometry into semi-ordered structures.

Example 2

Figure 12:
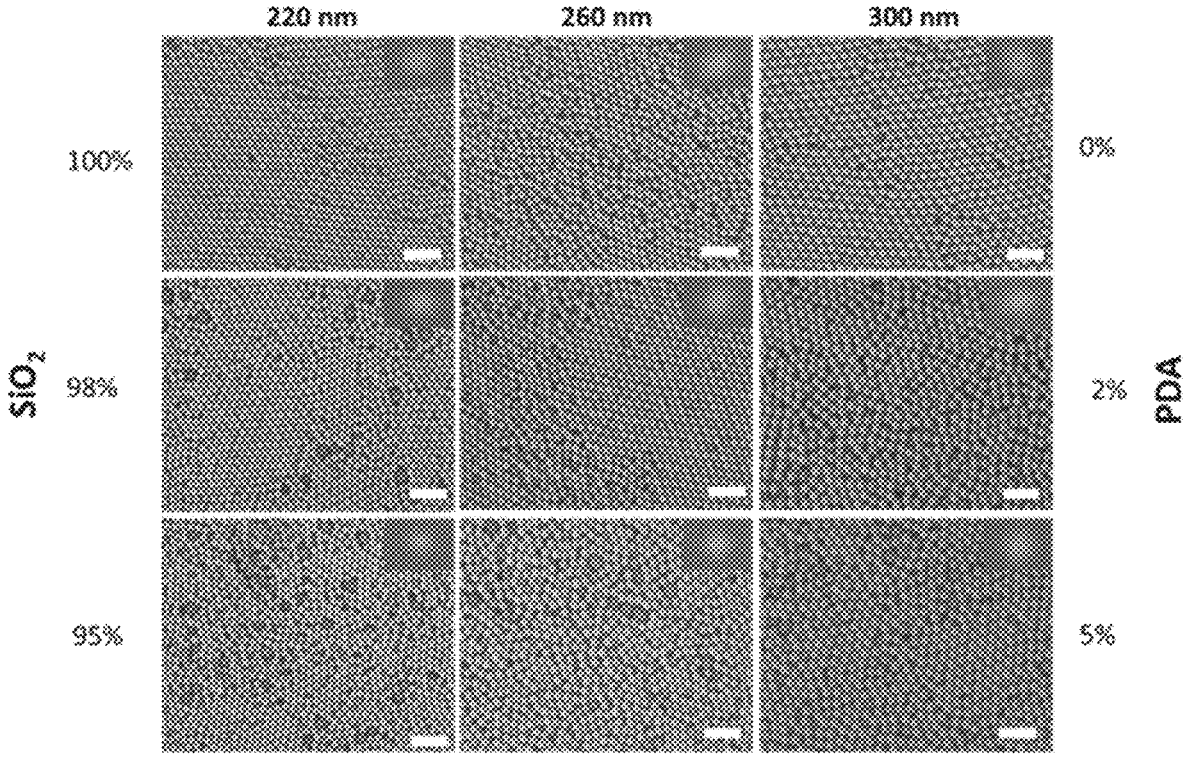
FIG. 12 is comparative SEM images of the colloidal assemblies formed by binary mixtures of $SiO_2$ particles (sizes—220, 260, and 300 nm dia.) and PDA (concentrations varying from 0, 2, and 5 wt %) during drop deposition. The insets represent the two-dimensional (2D) fast Fourier transformations of these micrographs, indicating the order of crystallinity for each type of binary mixture).

Evaluation of Nanostructural Assemblies Formed from $SiO_2$/PDA Particles at Different Particle Sizes and PDA Loadings The top row in FIG. 12 shows the scanning electron microscopy (SEM) images of the assemblies resulting from the packing of $SiO_2$ particles of sizes 220, 260 and 300 nm diameter (from left to right), without PDA. The two-dimensional (2D) fast Fourier transform (FFT) of these micrographs indicates semi-ordering with six-fold symmetry (hexagonal packing) (inset). These nanostructural assemblies (FIG. 11B) present a macroscopic effect when they interact with white light via scattering phenomenon to produce structural colors.

The middle and bottom panel of FIG. 12 show the scanning electron microscopy (SEM) images of the assemblies resulting from the packing of $SiO_2$ particles of sizes 220, 260 and 300 nm diameter (from left to right) with 2% (middle row) and 5% (bottom row) by weight (wt %) of PDA present. It can be observed from these images and the SEM images without PDA (top row) that PDA particles form defects that impede the long-range ordering of $SiO_2$ particles, giving rise to small crystalline domains. This behavior was further endorsed by performing FFT calculations on these SEM micrographs (insets in FIG. 12), which indicate loss of six-fold symmetry and prominence of concentric halos leading to increased short-range ordering. Thus, it can be concluded that the PDA particles in these binary systems reduce the overall crystallinity of the system.

Example 3

Figure 13A:
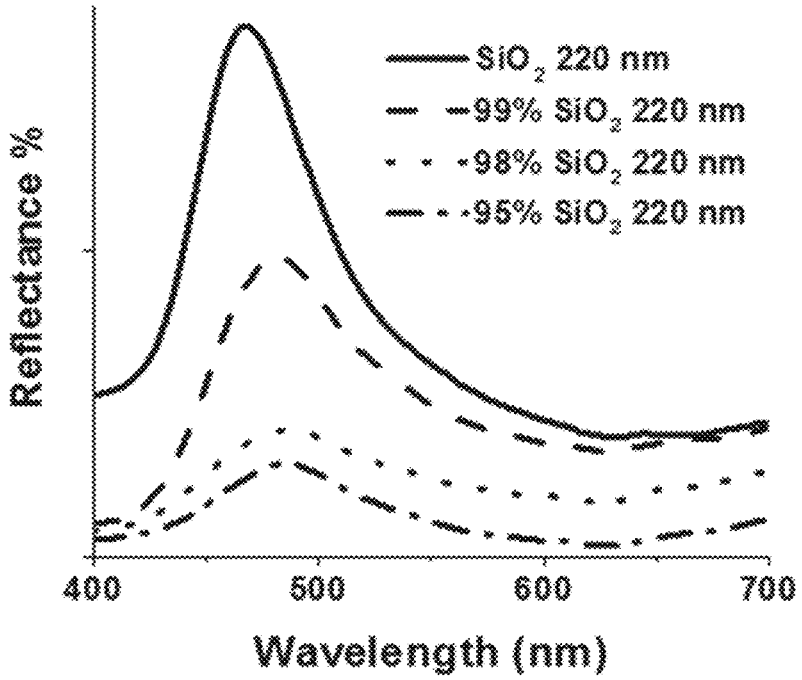
FIGS. 13A-C are plots of reflectance as a function of wavelength for binary mixtures of $SiO_2$ particles-220 nm (FIG. 13A), 260 nm (FIG. 13B), and 300 nm (FIG. 13C), and PDA particles with each plot depicting the effect of PDA incorporation on the reflectance spectra.
Figure 13B:
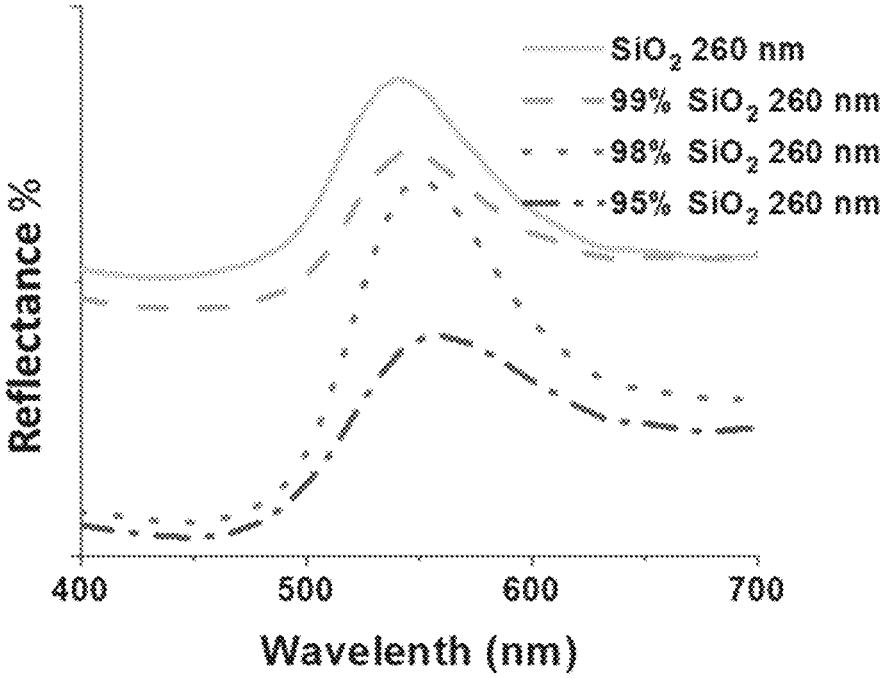
Figure 13C:
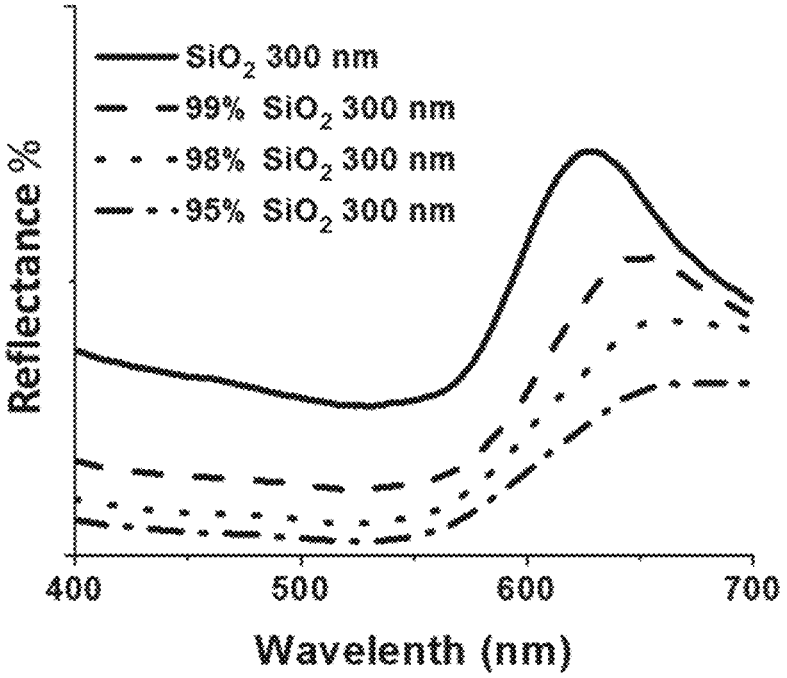
Figure 14A:
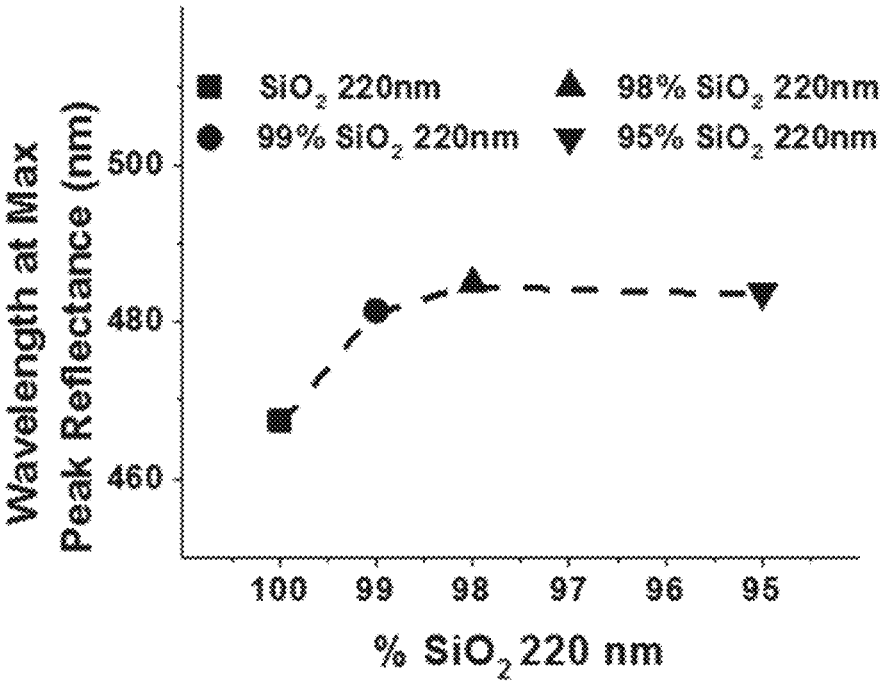
FIGS. 14A-C are plots of spectral peak position as a function of % $SiO_2$ for binary mixtures of $SiO_2$ particles-220 nm (FIG. 14A), 260 nm (FIG. 14B), and 300 nm (FIG. 14C), and PDA particles.
Figure 14B:
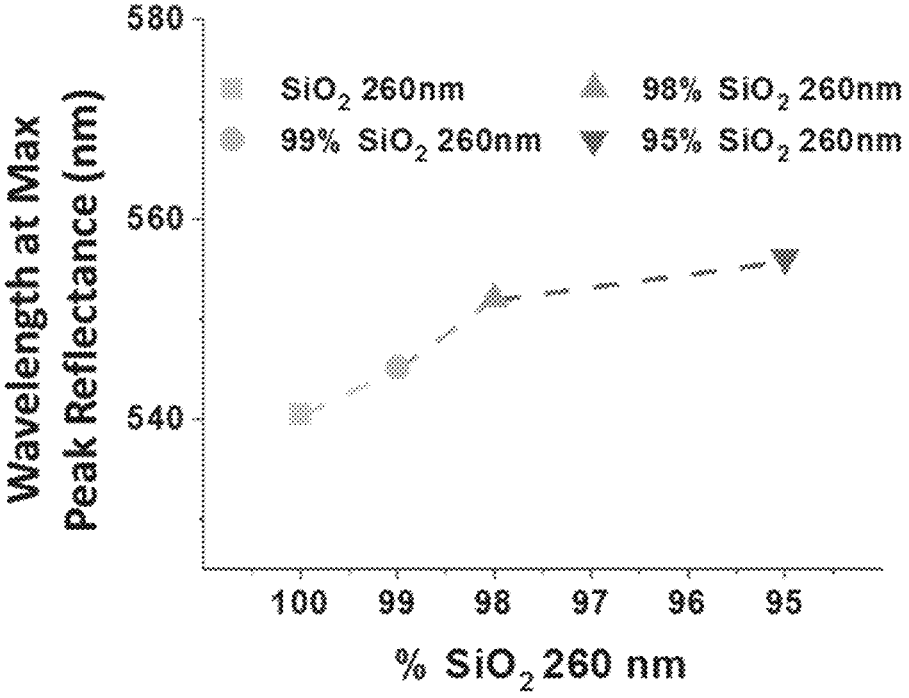
Figure 14C:
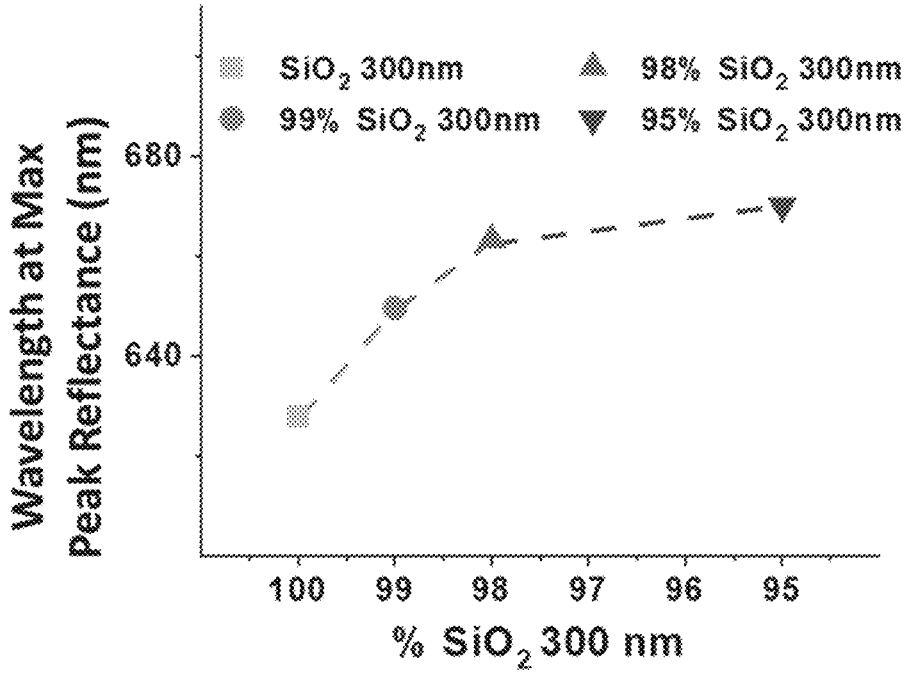

The Effect of Particle Size on Structural Colors Produced by $SiO_2$ Nanoparticles in the Presence of PDA Nanoparticles As set forth above, $SiO_2$ nanoparticles have been widely applied in the generation of structural colors over the years, giving whitish colors due to the high reflectance of incoherent background scattering. As described above in Examples 1 and 2, the particle sizes employed in the fabrication of colloidal assemblies play a key role in determining the hue produced by light scattering. Previous reports have shown that colloidal arrays exhibit a red-shift in the reflection peak with increasing particle diameter. The same effect was observed with the $SiO_2$/PDA nanoparticles as shown in FIGS. 8A-B, 13A-C and 14A-C. In these experiments, structural colors were produced by drop deposition and evaporation on perfluoro treated substrates using colloidal suspensions with $SiO_2$ nanoparticles with diameters of 220 nm, 260 nm, and 300 nm at PDA loadings of from 0 wt % 5 wt % and an overall particle concentration of 2% w/v. FIGS. 8A-B are photographs of printed dots prepared using binary mixtures of $SiO_2$ and PDA particles by drop deposition; starting with pure $SiO_2$, followed by incorporation of 1%, 2% and 5% (wt %) PDA particles and illustrate how the addition of PDA nanoparticles into a $SiO_2$ suspension of a particular size affects the lightness of the color, after drop deposition. This behavior can be represented graphically as a plot of reflectance as a function of wavelength, as shown in FIGS. 13A-C, with each plot depicting the effect of PDA incorporation on the reflectance spectra. As can be clearly seen from these plots that for each type of $SiO_2$ nanoparticle, the increasing amounts of PDA caused successive decreases in the peak reflectance values which is indicative of the lightness parameter. Moreover, the incorporation of PDA caused a small red-shift in the spectral peak position (less than 20 nm in each case). FIGS. 14A-C plot the spectral peak position as a function of wt % $SiO_2$ in each type of binary mixture. These plots suggest that the presence of PDA does not affect the hues dramatically, with the spectral peak-positions approaching a plateau with increased loading of PDA. Hence, it can be concluded that the primary role of the PDA in this binary mixture is to control the lightness of the hue produced, thereby improving the saturation of the structural colors produced.

In addition to controlling the lightness factor of structural colors, it was found that the inclusion of PDA also has morphological consequences. As set forth above in Example 2 above, the middle and bottom panel of FIG. 12 present the SEM images of nanostructures constructed using binary mixtures of $SiO_2$ and PDA nanoparticles, with varying weight percentages of PDA. It can be observed that PDA particles form defects that impede the long-range ordering of $SiO_2$ particles, giving rise to small crystalline domains. Again, this behavior can be further endorsed by performing FFT calculations on these scanning electron micrographs (insets in FIG. 12) which indicate loss of six-fold symmetry and prominence of concentric halos leading to increased short-range ordering. Thus, it can be concluded that the PDA particles in these binary systems reduce the overall crystallinity of the system.

As can be seen, this new approach reduces the amount of materials necessary and provides a simplified and efficient method for production of a wide variety of structural colors using the same binary system.

Example 4

Figure 15A:
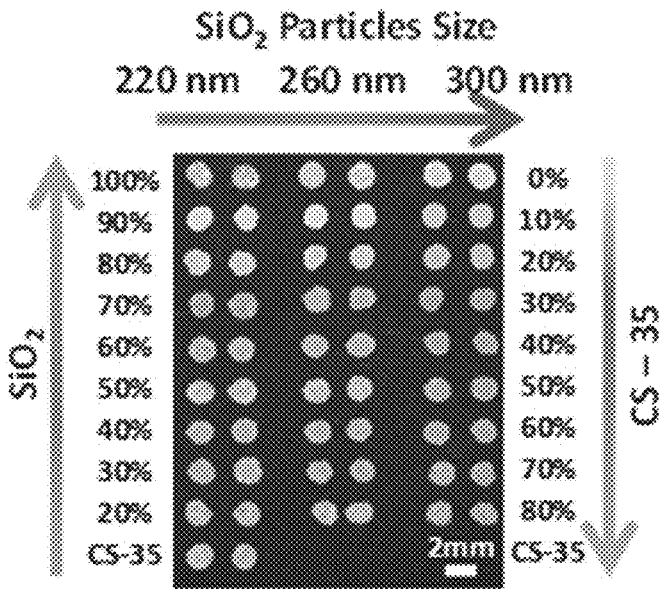
FIGS. 15A-B are photographs of the printed dots prepared using binary mixtures of $SiO_2$ and core-shell particles by drop deposition; starting with pure silica particles followed by the incorporation of 10%, 20%, . . . 80% of CS-35 by weight (wt %) (top to bottom) of three sizes of $SiO_2$ particles-220, 260 and 300 nm (from left to right), scale bar 2 mm (FIG. 15A) and optical micrographs of corresponding binary mixtures, scale bar 100 μm (FIG. 13B).
Figure 15B:
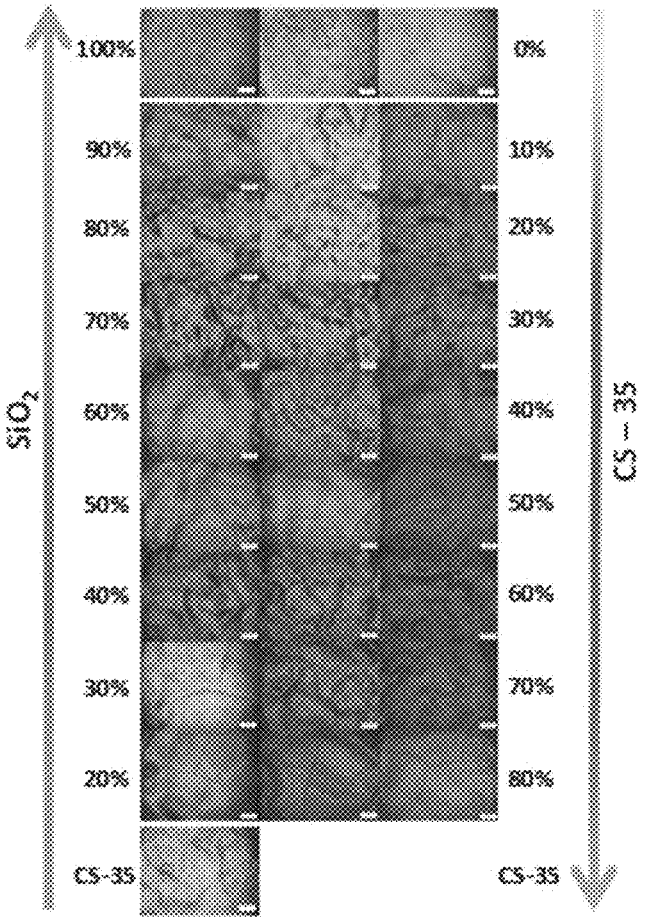
Figure 16A:
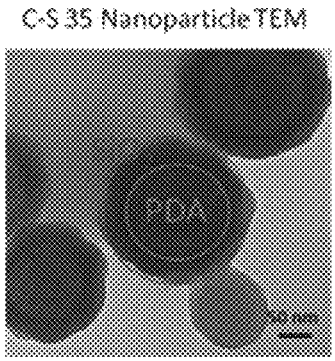
FIGS. 16A-C are a TEM (50 nm Scale bar) (FIG. 16A), a SEM (1 μm scale bar) (FIG. 16B) and optical images (100 μm scale bar) (FIG. 16C) of the CS-35 nanoparticle.
Figure 16B:
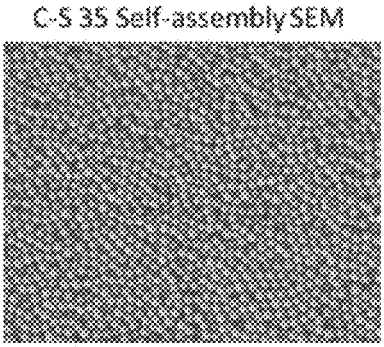
Figure 16C:
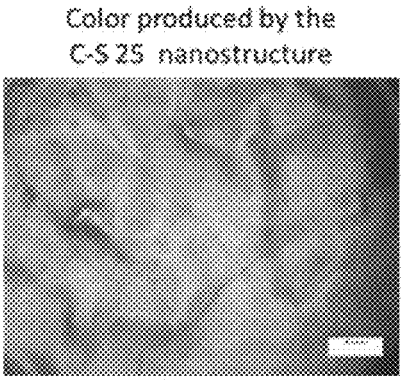

Generation of a Wide Gamut of Colors from Binary Mixtures of $SiO_2$ and Core-shell (CS) Nanoparticles FIGS. 15A-B shows multiple printed dots formed by drop deposition and evaporation of colloidal suspensions containing binary mixtures produced of $SiO_2$ and core-shell (CS) nanoparticles at an overall particle concentrations 2% w/v. The CS nanoparticles used in these experiments had a core diameter of 160 nm of PDA and a shell made of silica and having a thickness of 35 nm (C-S 35). TEM, SEM and optical images of the CS 35 nanoparticle are shown in FIGS. 16A-B. The colloidal nanostructure formed by pure CS-35 gives an olive-green color, as shown in FIG. 16C). This is believed to be due to a difference of the refractive index (RI) between the core and shell materials (high RI for the cores and low RI for the shells). This difference in refractive index (RI) is also known to generate brighter colors. The systematical addition of a certain size of $SiO_2$ nanoparticles immediately change the color perception, generating a broad gamut of colors when the amount of $SiO_2$ is increased as is shown in the printed dots (FIG. 15A) and their respective optical images (FIG. 15B). For the sake of nomenclature, when there is 80% of CS-35 (Green color), the remaining 20% corresponds to $SiO_2$ nanoparticles of a certain size (220, 260 or 300 nm), and thus provides the following nomenclature of "8G2," "8G6" or "8G0", which is consistent for the rest of concentrations used in FIGS. 15A-B.

Figure 17A:
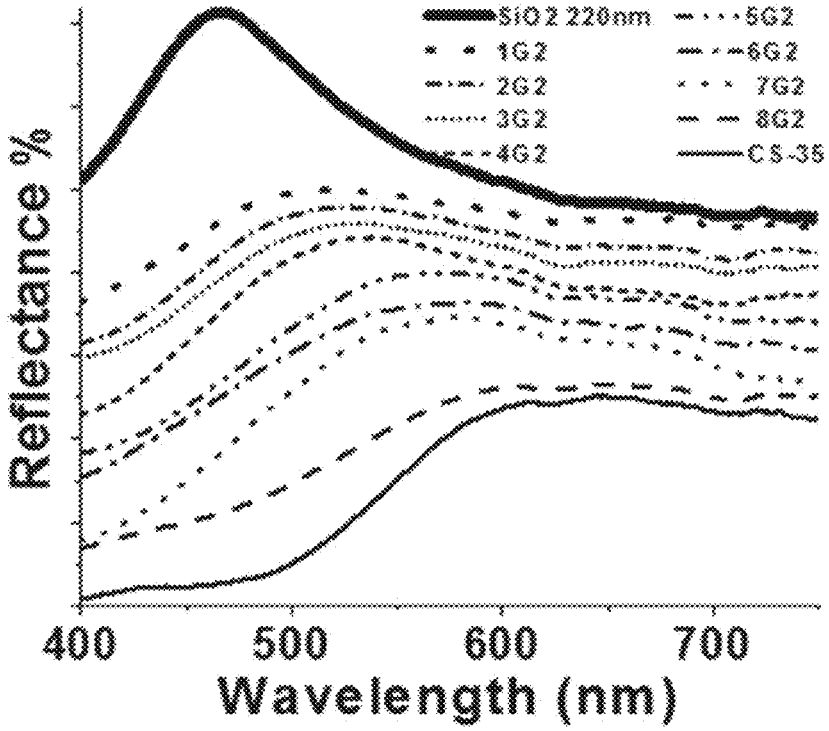
FIGS. 17A-C are plots showing reflectance as a function of wavelength for binary mixtures of $SiO_2$-220 nm (FIG. 17A), 260 nm FIG. 17B), and 300 nm (FIG. 17C), and CS-35 particles showing the significant shifts in the spectral peak position with increased loading of CS-35. All the reflectance curves have been offset along the Y-axis for clarity.
Figure 17B:
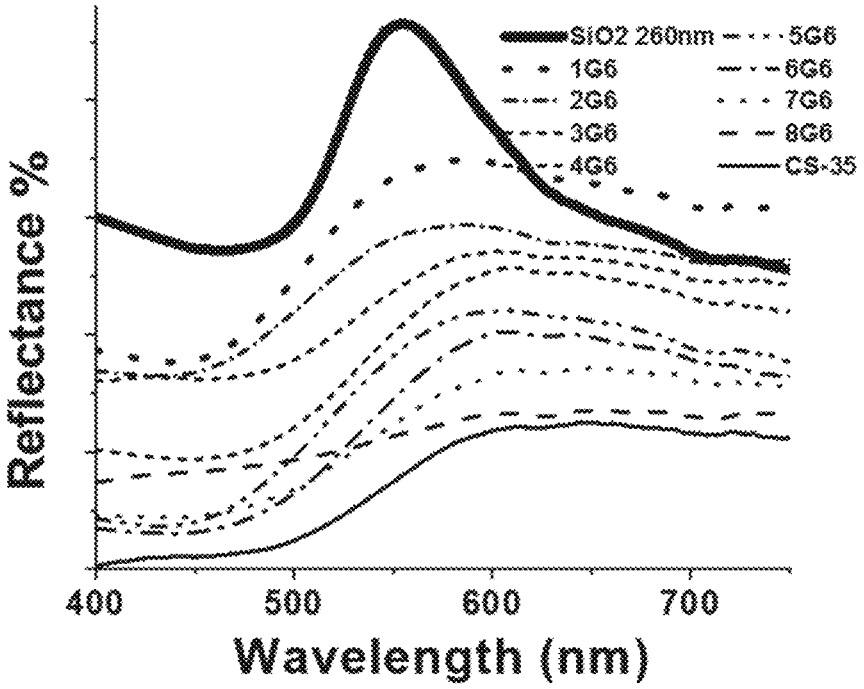
Figure 17C:
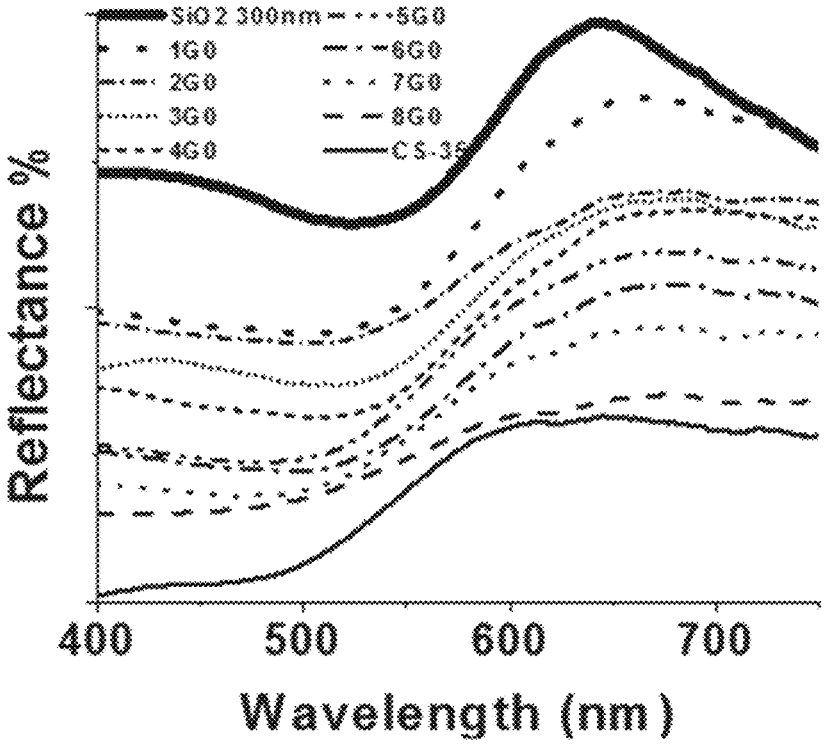
Figure 18:
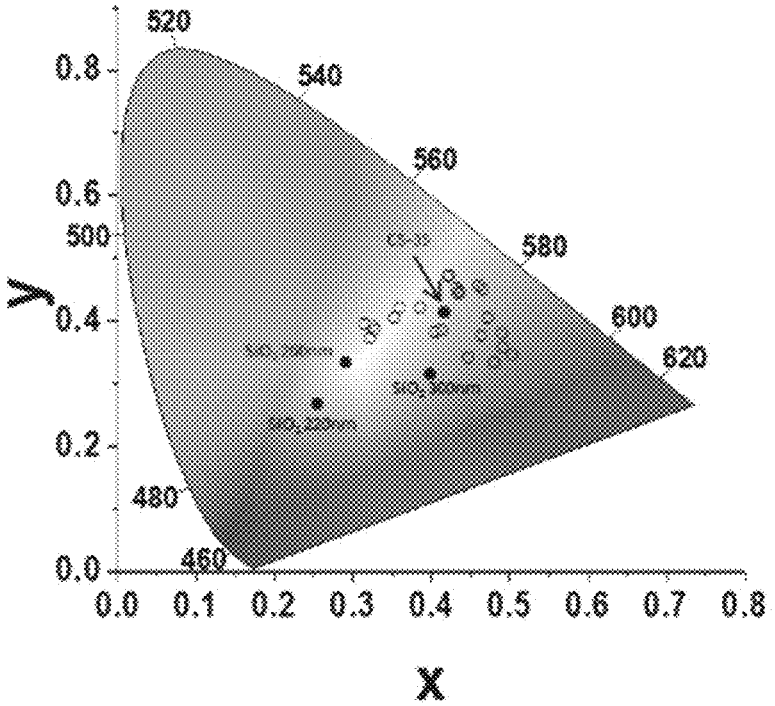
FIG. 18 The chromaticity diagram (CIE 1931 color space) of complete set of binary mixtures of FIGS. 15A-C, 17A-C.

The reflectance spectra collected in FIG. 17A correspond to the binary mixtures of $SiO_2$ 220 nm and CS-35 in varying proportions. As the core-shell concentration is increased, a red shift can be seen in the spectra, indicating a significant change in the colors. Same behavior can be seen in FIGS. 17B-C, which are collections of reflectance spectra for binary mixtures of $SiO_2$ (260 nm (FIG. 17B) and 300 nm (FIG. 17C), and CS-35 in varying proportions. FIG. 18 is the chromaticity diagram for the whole system (all colors in A), where it is possible to observe that the combination of two different particles allows the control of a large area of the chart by just adjusting the relative concentration of the $SiO_2$ and C-S 35 nanoparticles. Using nanostructures for the generation of a wide gamut of colors has been addressed in the past using different strategies that implicated rigorous synthesis of materials or laborious processes in order to obtain a variety of structural colors. In the color systems of the present invention, binary mixtures are used to produce a gamut of colors, without relying on tedious prior methods that required synthesizing different types of particles to get each color.

Figure 19A:
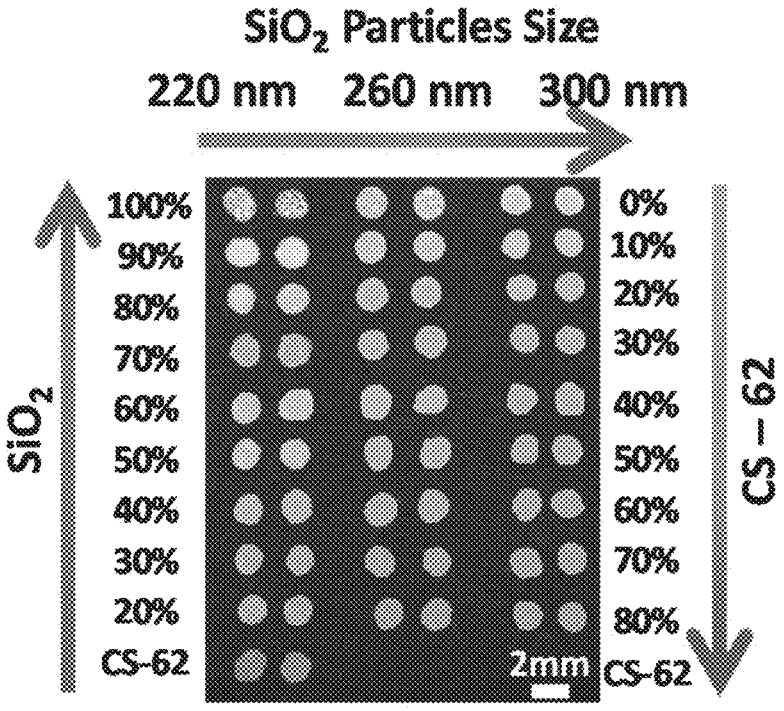
FIGS. 19A-B are photographs of the printed dots prepared using binary mixtures of $SiO_2$ and core-shell particles by drop deposition; starting with pure silica particles followed by the incorporation of 10%, 20%, . . . 80% of CS-62 by weight using three sizes of $SiO_2$ particles-220, 260 and 300 nm (from left to right) (scale bar 2 mm) (FIG. 19A) and optical micrographs of corresponding binary mixtures (scale bar 100 μm) (FIG. 19B).
Figure 19B:
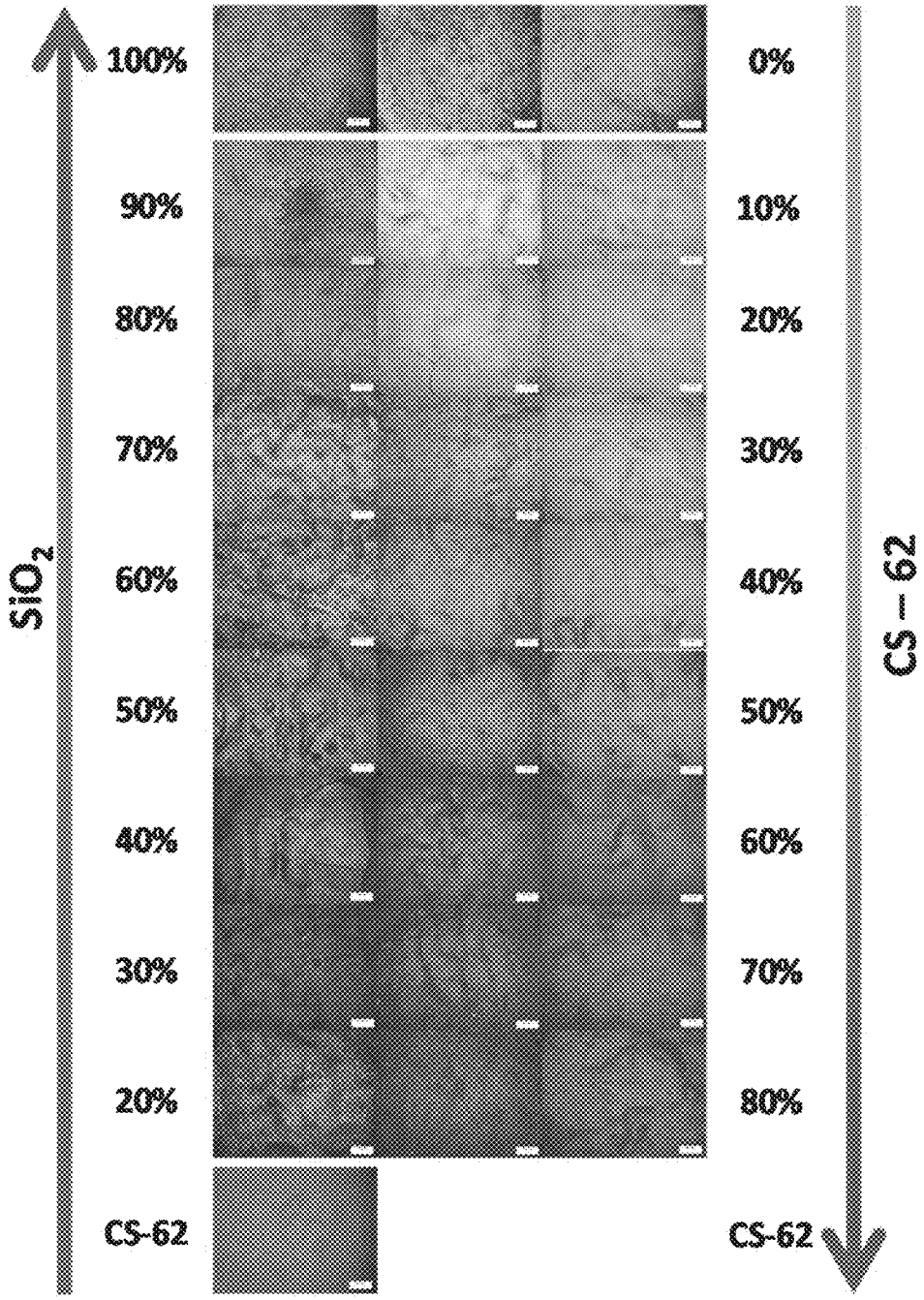

In a second set of experiments, the above referenced procedures were repeated using a different core-shell nanoparticle. In these experiments, multiple printed dots formed by drop deposition and evaporation of colloidal suspensions containing binary mixtures produced of $SiO_2$ and core-shell (CS) nanoparticles having a PDA core of 160 nm in diameter and a silica shell of 62 nm (CS-62) (FIGS. 4A-B) at an overall particle concentration of 2% w/v. When pure CS-62 is printed, it gives a reddish hue as shown in FIG. 4C). Again, this is believed to be due to a difference of the refractive index (RI) between the core and shell materials (high RI for the cores and low RI for the shells). The systematical addition of a certain size of $SiO_2$ nanoparticles immediately changes the color perception, generating a broad gamut of colors when the amount of $SiO_2$ is increased as is shown in the printed dots (FIG. 19A) and their respective optical images (FIG. 19B). As mentioned earlier, when there is 80% of CS-62 (Reddish color), the remaining 20% corresponds to $SiO_2$ nanoparticles of a certain size (220, 260 or 300nm), and thus provides the following nomenclature of "8R2," "8R6" or "8R0", which is consistent for the rest of concentrations used in FIGS. 19A-B.

Figure 20A:
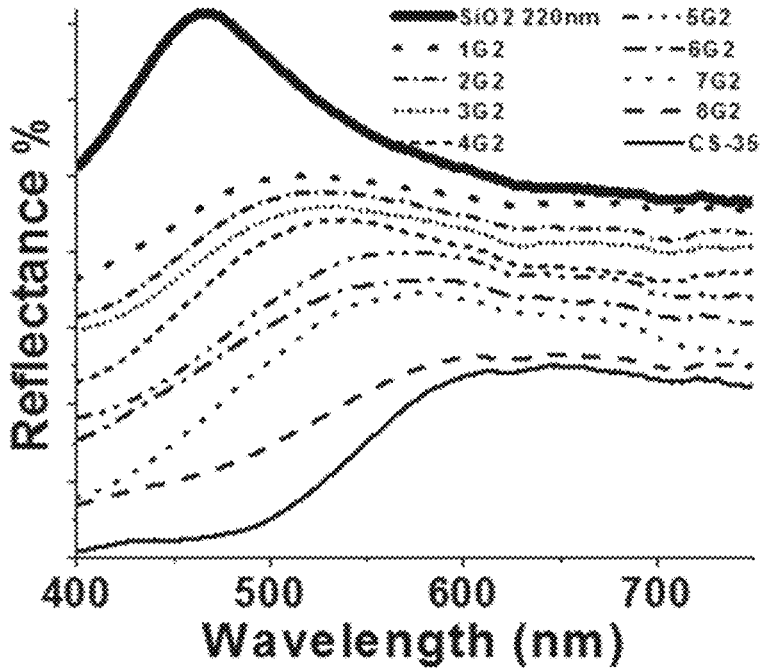
FIGS. 20A-C are the plots of reflectance as a function of wavelength for binary mixtures of $SiO_2$-220 nm (FIG. 20A), 260 nm (FIG. 20B), and 300 nm (FIG. 20C), and CS-62 particles, showing significant shifts in the spectral peak position with increased loading of CS-62. All the reflectance curves have been offset along the Y-axis for clarity.
Figure 20B:
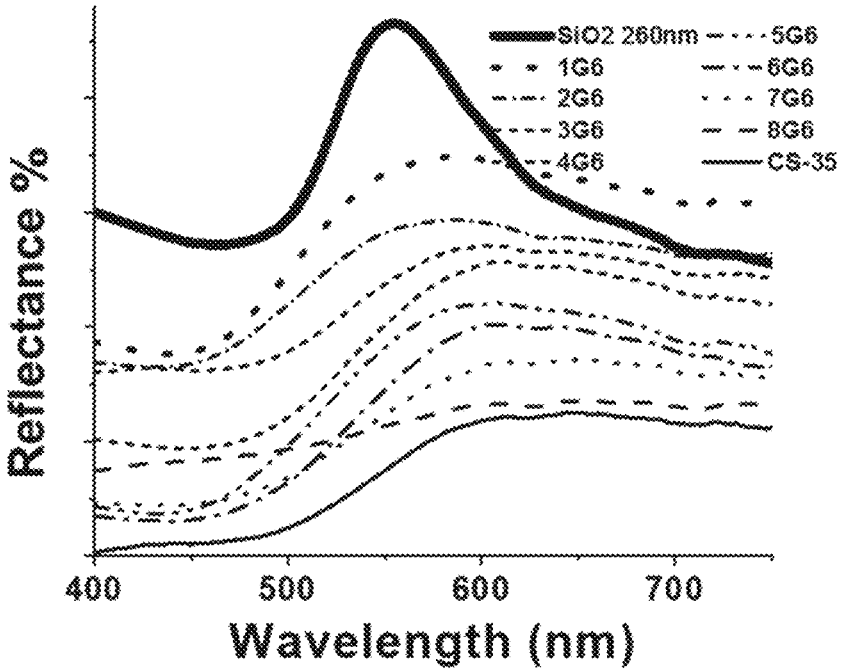
Figure 20C:
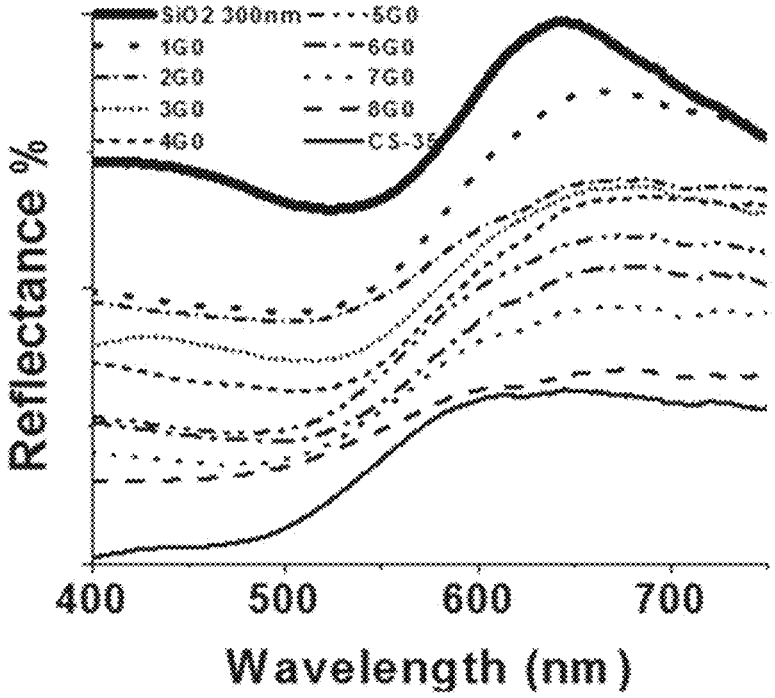
Figure 21:
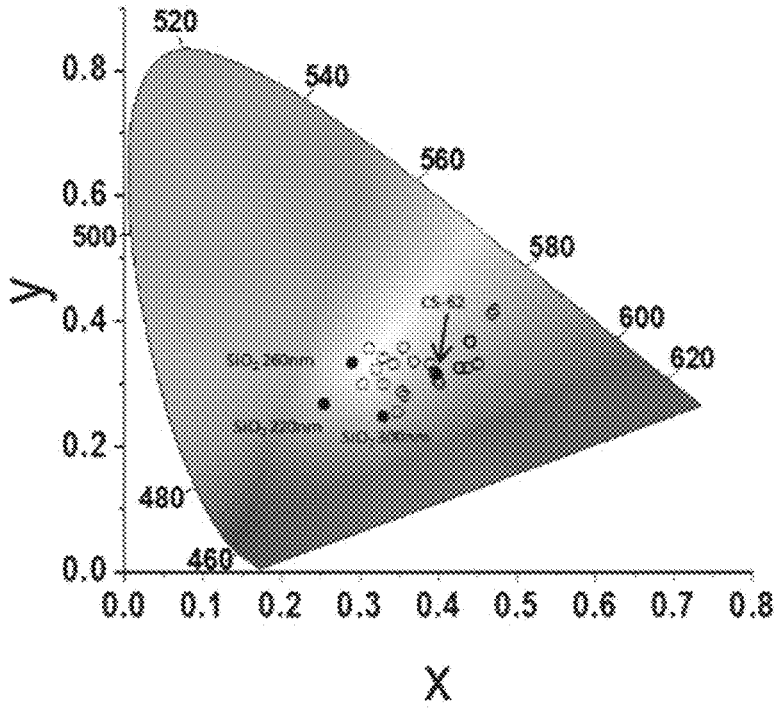
FIG. 21 is the chromaticity diagram (CIE 1931 color space) of complete set of binary mixtures of FIGS. 19A-B and 20A-C.

The reflectance spectra collected in FIG. 20A correspond to the binary mixtures of $SiO_2$ 220 nm and CS-62 in varying proportions. Here again, as the core-shell concentration is increased, a red shift can be seen in the spectra, indicating a change in the colors. The same behavior can be seen in FIGS. 20B-C, which are collections of reflectance spectra for binary mixtures of $SiO_2$ (260 nm (FIG. 20B) and 300 nm (FIG. 20C), each) and CS-62 in varying proportions, producing different colors. FIG. 21 is the chromaticity diagram for the whole system (all colors in FIG. S3A), where it is possible to observe that the combination of two different particles allows the control of a large area of the chart by simply adjusting the relative proportions of the $SiO_2$ and CS-62 nanoparticles.

As can be seen, this new approach reduces the amount of materials necessary and provides a simplified and efficient method for production of a wide variety of structural colors using the same binary system.

Example 5

Evaluation of Printing on Different Substrates

Figure 22A:
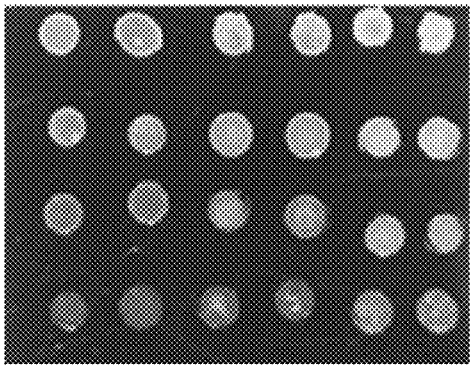
FIGS. 22A-D are photographs of printed structural colors using binary mixtures of $SiO_2$ and PDA nanoparticles formed by drop deposition on a variety of substrates: plastic (PVC) (FIG. 22A), metal (stainless steel) (FIG. 22B), nitrile rubber (FIG. 22C), and textile fabric (FIG. 22D).
Figure 22B:
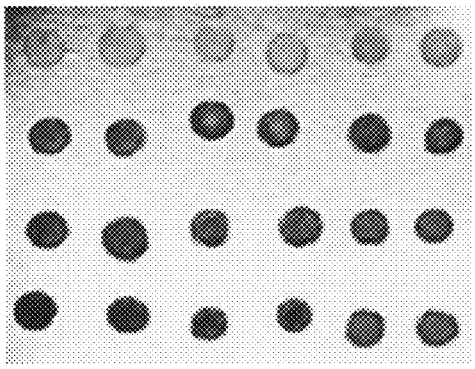
Figure 22C:
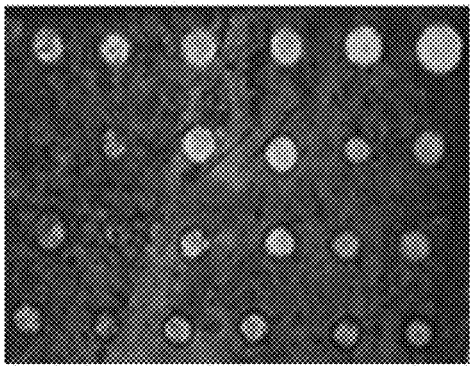
Figure 22D:
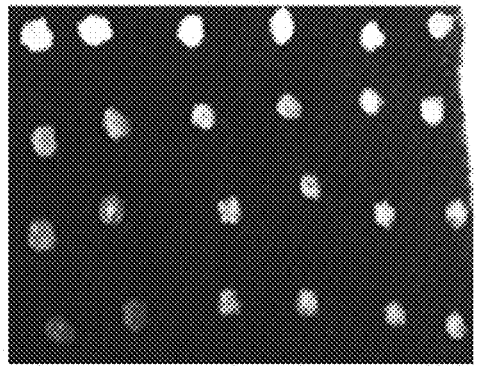
Figure 23A:
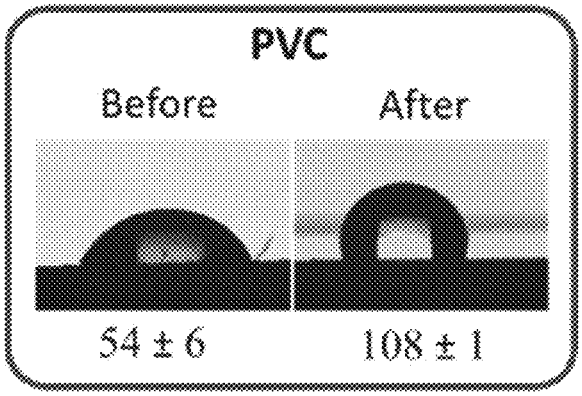
FIGS. 23A-D are images showing the contact angle of water before and after perfluorination of PVC (FIG. 23A), Stainless steel (FIG. 23B), Rubber (nitrile) (FIG. 20C) and Fabric (FIG. 20D). The water exhibited complete spreading for the case of fabric before perfluorination, so no image of the contact angle of water before perfluorination could be taken for fabric.
Figure 23B:
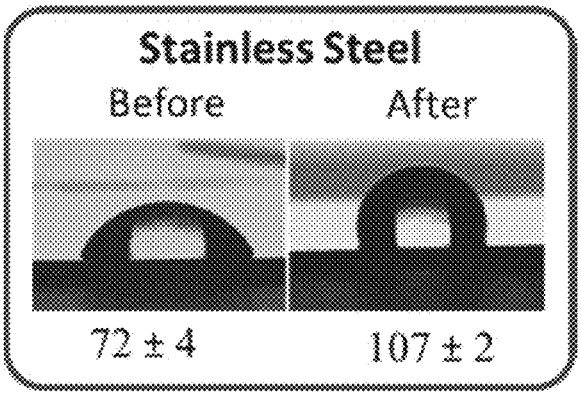
Figure 23C:
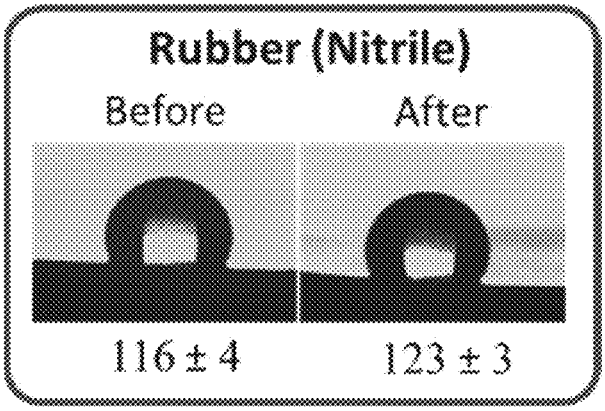
Figure 23D:
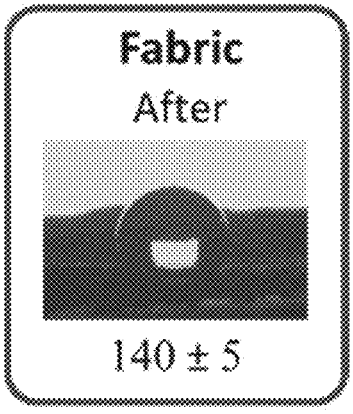

As set forth above, the cold-plasma treatment is a benign methodology to treat any substrate surface allowing its use with a wide number of substrates like paper, plastics, metals, fabrics, rubbers and elastomers, to name a few. In these experiments, PVC, stainless steel, nitrile rubber, and textile fabric substrates were treated with 1H,1H,2H-perfluoro-1-dodecene (perfluoro) by plasma-enhanced vapor deposition and were evaluated by drop deposition of binary mixtures of $SiO_2$ and PDA nanoparticles similar to those used in Example 2, where the concentration of PDA was increased from 1, 2, 5%. The resulting structural colors are shown in FIG. 22A (PVC), FIG. 22B (stainless steel), FIG. 22C (nitrile rubber), and FIG. 22D textile fabric. It is believed that the ability to print effectively on these substrates stems from the higher contact angles made by carrier solvent (here, water) on these substrates after the pre-treatment (as shown in the FIGS. 23A-D). These contact angles reflect the inability of the colloidal suspension to be absorbed into or spread or run over the substrate, thereby enabling the colloidal particles to assemble into nanostructures. The contact angles are also influenced by the roughness of the substrate surfaces, with the contact angles being higher with roughness. The smaller printed dots (as observed in case of textile fabric) can be attributed to very high contact angles, since then provided a smaller confined region for the particles to assemble. Furthermore, it has been observed that the colloidal suspension adheres easily on rough surfaces, which is important in the printing application in order to keep the colloidal ink in place or static on the substrate surface.

Example 6

Applications in Anti-counterfeiting-concealable Patterns

Figure 24A:
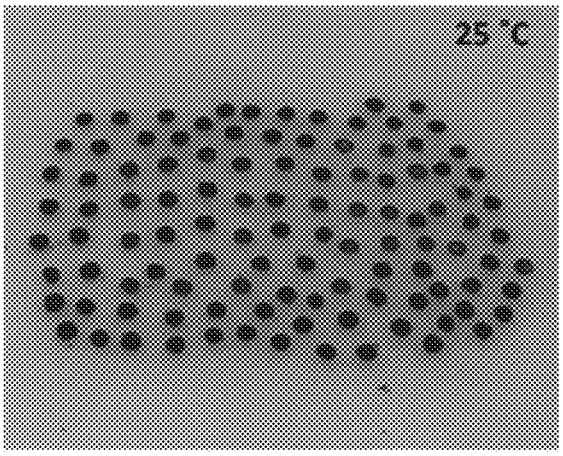
FIGS. 24A-B are images showing a "UA" pattern printed using binary mixtures of $SiO_2$ 260 nm and 2% of PDA (green), in a background filled using $SiO_2$ 220 nm and 2% PDA (blue) on a substrate dressed with a thermochromic epoxy resin. The photographs were taken at two different conditions: at room temperature (25° C.) (FIG. 24A) and at 15° C.
Figure 24B:
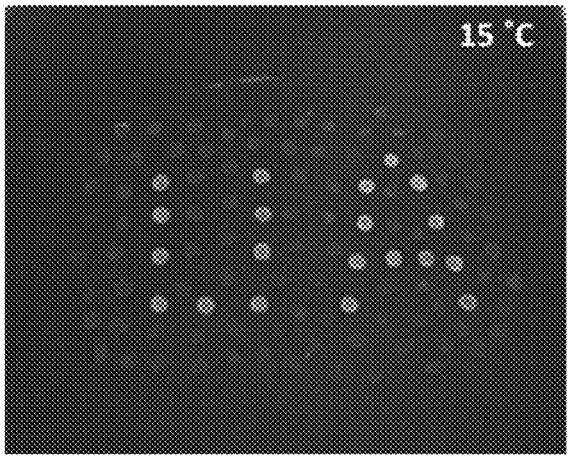

In these experiments, thermochromic microcapsules, a temperature-responsive material that changes from white to black on cooling from room temperature to 15° C., were loaded in an epoxy resin matrix at a concentration of about 1.5 wt %. The thermochromic microcapsule resin was then dispersed on the substrate surface. The substrate was then treated with perfluoro by plasma-enhanced vapor deposition, as described above and a "UA" pattern printed on the treated substrate surface using binary mixtures of 260 nm $SiO_2$ nanoparticles and 2 wt % of PDA nanoparticles (green), in a background filled using $SiO_2$ 220 nm and 2 wt % PDA (blue). FIGS. 24A-B are photographs taken at room temperature (25° C.) (FIG. 24A) and at 15° C. (FIG. 24B), to illustrate an indirect effect of temperature on structural colors by changing the background contrast. As can be seen, the printed patterns were indistinguishable at room temperature (FIG. 24A). On cooling, however, the thermochromic microcapsules generated the necessary contrast to perceive identifiable "UA" pattern/messages (FIG. 24B), exhibiting an indirect, stimuli-responsive structural color behavior with temperature.

Responsive structural colors have been an area of significant interest with color changes responsive to stimuli like solvents, humidity or mechanical actions. These experiments demonstrate a simplified approach of an indirect structural color-response to temperature by changing the background contrast to conceal information and thereby opening an avenue towards developing anti-counterfeiting technologies.

In light of the foregoing, it should be appreciated that the present invention significantly advances the art by providing a method for applying or printing structural colors that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A method for applying structural colors to a substrate comprising:

A) treating some or all of a surface of a substrate with a hydrophobic and/or oleophobic coating;

B) preparing a structural color forming suspension comprising a carrier solvent and a plurality of nanoparticles known to form a structural color upon evaporation of the carrier solvent;

C) placing said structural color forming suspension on the treated surface of said substrate, wherein said hydrophobic and/or oleophobic coating on the surface of said substrate substantially prevents adsorption of a structural color forming suspension into said substrate and substantially prevents the structural color forming suspension from moving on said surface; and D) allowing the carrier solvent to evaporate, whereby the nanoparticles organize to produce a structural color on said substrate.

2. The method of claim 1 wherein the substrate is selected from the group consisting of paper, cardboard, plastic, metal, textiles, rubbers and elastomers, wood, glass, and combinations thereof.

3. The method of claim 1 wherein the step of treating a substrate comprises applying a material selected from the group of 1H,1H,2H-perfluoro-1-dodecene ($C_{10}F_{21}$—CH=$CH_2$), fluoroalkyls, fluorohydroalkyls, cyclo-fluoroalkyls, fluorobenzenes, and combinations thereof, to the substrate by plasma-enhanced vapor deposition.

4. The method of claim 1 wherein the step of treating the substrate is performed by plasma-enhanced vapor deposition, layer-by-layer polymer coating, spin coating, or solvent casting.

5. The method of claim 1 wherein the step of treating the substrate comprises application of 1H,1H,2H-perfluoro-1-dodecene ($C_{10}F_{21}$—CH═$CH_2$) by plasma-enhanced vapor deposition.

6. The method of claim 1 wherein the step of allowing the solvent to evaporate takes place at a temperature of from about 30° C. to about 90° C.

7. The method of claim 1 wherein the hydrophobic and/or oleophobic coating is hydrophobic, superhydrophobic, oleophobic or a combination thereof.

8. The method of claim 1 wherein the substrate changes colors at elevated temperatures obscuring or changing the appearance of the structural color produced thereon.

9. The method of claim 1 wherein said plurality of nanoparticles comprises melanin, polydopamine (PDA), silica ($SiO_2$), calcium carbonate, carbon black, polymers, polystyrene, poly(methyl methacrylate), metals, silver, gold metal oxides, $TiO_2$, alumina, iron oxides; core-shell particles, core-shell particles comprising melanin or polydopamine (PDA) and silica ($SiO_2$), or combinations thereof.

10. The method of claim 1 wherein said plurality of nanoparticles comprises melanin or polydopamine (PDA).

11. The method of claim 1 wherein said plurality of nanoparticles comprises core-shell nanoparticles having a $SiO_2$ shell and a melanin or PDA core.

12. The method of claim 1 wherein said plurality of nanoparticles comprises a core-shell nanoparticles having a $SiO_2$ shell and a melanin or PDA core and at least one other type of nanoparticles having a different diameter, structure, or chemistry.

13. The method of claim 1 wherein said plurality of nanoparticles have diameters of from about 40 nm to about 500 nm.

14. The method of claim 1 wherein the concentration of said plurality of nanoparticles in the structural color forming suspension is from 0.5% w/v to about 10% w/v.

15. The method of claim 1 further comprising:

E) laminating the structural color of step D with a transparent plastic, synthetic rubber, natural rubber, or elastomer material to protect the structural color from damage.

16. The method of claim 1 wherein the step of placing said structural color forming suspension on said substrate comprises printing, spraying, brush coating, or roll coating.

17. The method of claim 1 wherein the structural color produced may be estimated from their reflectance spectra and chromaticity diagrams.

18. A method for printing a color image on a substrate using structural colors comprising:

A) treating a surface of a substrate with a hydrophobic and/or oleophobic coating;

B) preparing one or more structural color forming suspensions each comprising a carrier solvent and a plurality of nanoparticles known to form a particular structural color upon evaporation of the carrier solvent;

C) loading said one or more structural color forming suspensions into a printer configured to apply said one or more structural color forming suspensions to the treated surface of said substrate at predetermined locations on the treated surface of said substrate to form a desired image;

D) printing the one or more structural color forming suspensions at predetermined locations on the treated surface of said substrate;

E) allowing said one or more carrier solvents to evaporate at a temperature of from about 30° C. to about 90° C. to form the desired image from the structural colors produced by said one or more structural color forming suspensions upon evaporation of the one or more carrier solvents.

19. The method of claim 18 wherein the step of preparing one or more suspensions comprises preparing three or more structural color forming suspensions each comprising a carrier solvent and a plurality of nanoparticles known to form a particular structural color upon evaporation of the solvent and the step of loading comprises loading said three or more structural color forming suspensions into said printer.

20. The method of claim 18 further comprising:

F) laminating the image formed from the particular structural colors produced by said two or more suspensions upon evaporation of the solvent of step D with a transparent plastic, natural or synthetic polymer, and/or elastomer material.

21. The method of claim 18 wherein the step of treating comprises applying 1H,1H,2H-perfluoro-1-dodecene ($C_{10}F_{21}$—CH═$CH_2$) by plasma-enhanced vapor deposition.

22. A method for printing a color image using structural colors comprising:

A) treating a surface of a substrate by applying 1H,1H,2H-perfluoro-1-dodecene ($C_{10}F_{21}$—CH═$CH_2$) by plasma-enhanced vapor deposition;

B) preparing one or more structural color forming suspensions each comprising a carrier solvent and a plurality of core-shell nanoparticles having a $SiO_2$ shell and a melanin or PDA core known to form a particular structural color upon evaporation of the carrier solvent;

C) loading said one or more structural color forming suspensions into a printer configured to apply said one or more structural color forming suspensions to the treated surface of said substrate at predetermined locations on the treated surface of said substrate to form a desired image;

D) printing the one or more structural color forming suspensions at predetermined locations on the treated surface of said substrate;

E) allowing said one or more carrier solvents to evaporated at a temperature of from about 30° C. to about 90° C. to form the desired image from the structural colors produced by said one or more structural color forming suspensions upon evaporation of the one or more carrier solvents.

23. The method of claim 22 further comprising:

F) laminating the image formed from the particular structural colors produced by said two or more suspensions upon evaporation of the solvent of step D with a transparent plastic, natural or synthetic polymer, and/or elastomer material.

24. The method of claim 22 wherein at least one of said one or more structural color forming suspensions further comprises a dark absorber or a plurality of $SiO_2$ nanoparticles.

* * * * *